US008656622B2

(12) United States Patent
Peterson et al.

(10) Patent No.: US 8,656,622 B2
(45) **Date of Patent: *Feb. 25, 2014**

(54) TACTICAL FIREARM SYSTEMS AND METHODS OF MANUFACTURING SAME

(75) Inventors: Morris Peterson, Earlysville, VA (US); Matthew Peterson, Crozet, VA (US); Charles Robert Overbey, Jr., Deland, FL (US); Gary Vance, Bristol, VA (US); William McCormick, Bluff City, TN (US)

(73) Assignee: Ashbury International Group, Inc., Ruckersville, VA (US)

( * ) Notice: Subject to any disclaimer, the term of this patent is extended or adjusted under 35 U.S.C. 154(b) by 1248 days.

This patent is subject to a terminal disclaimer.

(21) Appl. No.: 12/251,384

(22) Filed: Oct. 14, 2008

(65) Prior Publication Data

US 2012/0079752 A1 Apr. 5, 2012

Related U.S. Application Data

(60) Provisional application No. 60/979,301, filed on Oct. 11, 2007, provisional application No. 61/100,788, filed on Sep. 29, 2008.

(51) Int. Cl.
*F41A 21/00* (2006.01)

(52) U.S. Cl.
USPC ..... 42/75.03; 42/124

(58) Field of Classification Search
USPC ..... 42/75.03, 71.01, 73, 124
See application file for complete search history.

(56) References Cited

U.S. PATENT DOCUMENTS 2,387,691 A 10/1945 Sunderland
3,209,481 A 10/1965 Gilbert
3,323,246 A * 6/1967 Loffler ..... 42/75.01

(Continued)

FOREIGN PATENT DOCUMENTS

DE 3743092 7/1988
DE 3743092 A1 7/1988

OTHER PUBLICATIONS

"Specification —Sako TRG Sharpshooting System", Specification, Sep. 28, 2001, Sako Ltd, available at http://www.sako.fi/pdf/specsITRG.pdf.

(Continued)

*Primary Examiner* — Michelle Clement
(74) *Attorney, Agent, or Firm* — Troutman Sanders LLP; Robert R. Elliott, Jr.

(57) ABSTRACT

Tactical firearm systems and methods of manufacturing tactical firearm systems are discussed herein. In some embodiments, a tactical weapons platform can comprise a forend assembly adapted to house a portion of a barrel; a receiver assembly detachably coupled to the forend assembly and adapted to interface with a bolt action; and a butt stock assembly detachably coupled to the receiver assembly. In other embodiments, a modular stock assembly for a bolt action rifle can generally comprise a forend assembly, a receiver assembly, and a butt stock assembly. The forend assembly can have a body adapted to house a barrel in a free floating configuration, wherein the body surrounds at least a portion of the length of the barrel. The receiver assembly can be detachably coupled to the forend assembly and adapted to directly interface with a bolt action without bedding. The butt stock assembly can be detachably coupled the receiver assembly by a hinge. Other aspects, features, and embodiments are also claimed and described herein.

7 Claims, 22 Drawing Sheets

(56) References Cited

U.S. PATENT DOCUMENTS

| | | | | |
|---|---|---|---|---|
| 3,369,316 | A | 2/1968 | Miller | |
| 3,512,290 | A | 5/1970 | La Violette, Jr. et al. | |
| 3,543,428 | A | 12/1970 | Bronson | |
| 3,618,249 | A | 11/1971 | Grandy | |
| 3,739,515 | A * | 6/1973 | Koon, Jr. | 42/75.03 |
| 3,830,003 | A | 8/1974 | Clerke | |
| 3,999,461 | A | 12/1976 | Johnson et al. | |
| 4,203,244 | A | 5/1980 | Hickman | |
| 4,383,384 | A | 5/1983 | Fox | |
| 4,402,152 | A | 9/1983 | Casull | |
| 4,430,822 | A | 2/1984 | Fromming et al. | |
| 4,651,455 | A | 3/1987 | Geiser, Jr. | |
| 4,674,216 | A | 6/1987 | Ruger et al. | |
| 4,685,237 | A | 8/1987 | Hugg | |
| 4,735,007 | A | 4/1988 | Gal | |
| D297,855 | S | 9/1988 | Ruger et al. | |
| 4,790,095 | A | 12/1988 | Campos | |
| D304,223 | S | 10/1989 | Ruger et al. | |
| 4,887,374 | A | 12/1989 | Santarossa | |
| 4,920,677 | A | 5/1990 | Schuerman | |
| 4,944,109 | A | 7/1990 | Zedrosser | |
| 5,020,260 | A | 6/1991 | Houghton | |
| 5,048,215 | A | 9/1991 | Davis | |
| D324,557 | S | 3/1992 | Livingston | |
| 5,149,899 | A | 9/1992 | Dabrowski | |
| 5,173,564 | A | 12/1992 | Hammond, Jr. | |
| 5,209,215 | A | 5/1993 | Morrison | |
| 5,417,002 | A | 5/1995 | Guerra | |
| 5,440,963 | A | 8/1995 | Szecsei | |
| 5,590,484 | A | 1/1997 | Mooney et al. | |
| 5,642,581 | A | 7/1997 | Herold et al. | |
| 5,711,102 | A | 1/1998 | Plaster et al. | |
| D391,334 | S | 2/1998 | Plaster et al. | |
| D403,043 | S | 12/1998 | Spekner | |
| 5,900,577 | A | 5/1999 | Robinson et al. | |
| 5,987,797 | A | 11/1999 | Dustin | |
| 6,293,040 | B1 | 9/2001 | Luth | |
| 6,487,805 | B1 | 12/2002 | Reynolds | |
| 6,497,065 | B1 | 12/2002 | Huston | |
| 6,591,533 | B2 * | 7/2003 | Wygant | 42/72 |
| 6,598,329 | B1 * | 7/2003 | Alexander | 42/71.01 |
| 6,598,330 | B2 | 7/2003 | Garrett et al. | |
| 6,637,142 | B1 | 10/2003 | Reynolds | |
| 6,836,990 | B2 * | 1/2005 | Shiloni | 42/96 |
| 6,839,998 | B1 | 1/2005 | Armstrong | |
| D510,401 | S | 10/2005 | Murello et al. | |
| 7,024,812 | B2 | 4/2006 | Nelson | |
| 7,131,228 | B2 | 11/2006 | Hochstrate et al. | |
| 7,152,355 | B2 | 12/2006 | Fitzpatrick et al. | |
| 7,162,823 | B2 * | 1/2007 | Schoppman et al. | 42/75.01 |
| 7,313,883 | B2 * | 1/2008 | Leitner-Wise | 42/75.02 |
| 7,325,351 | B1 | 2/2008 | Leung | |
| 7,386,952 | B1 | 6/2008 | Henretty | |
| 7,428,795 | B2 | 9/2008 | Herring | |
| 7,574,823 | B2 * | 8/2009 | Nakayama | 42/75.02 |
| D603,013 | S * | 10/2009 | Fitzpatrick et al. | D22/108 |
| D606,614 | S * | 12/2009 | Fitzpatrick et al. | D22/103 |
| 2003/0051385 | A1 * | 3/2003 | Wygant | 42/72 |
| 2003/0110675 | A1 | 6/2003 | Garrett et al. | |
| 2003/0230022 | A1 * | 12/2003 | Battaglia | 42/111 |
| 2004/0000083 | A1 | 1/2004 | Grant, Jr. | |
| 2004/0211104 | A1 | 10/2004 | Eberle | |
| 2004/0226212 | A1 * | 11/2004 | Shiloni | 42/96 |
| 2005/0000142 | A1 | 1/2005 | Kim et al. | |
| 2005/0183317 | A1 | 8/2005 | Finn | |
| 2005/0229466 | A1 | 10/2005 | Muhlestein | |
| 2005/0241211 | A1 | 11/2005 | Swan | |
| 2005/0262752 | A1 * | 12/2005 | Robinson et al. | 42/71.01 |
| 2006/0010748 | A1 * | 1/2006 | Stoner et al. | 42/71.01 |
| 2006/0010749 | A1 | 1/2006 | Kincel | |
| 2006/0174532 | A1 | 8/2006 | Popikow | |
| 2006/0236582 | A1 | 10/2006 | Lewis et al. | |
| 2006/0242880 | A1 | 11/2006 | Griffin | |
| 2006/0254111 | A1 | 11/2006 | Giauque et al. | |
| 2006/0277810 | A1 | 12/2006 | Leitner-Wise | |
| 2006/0283067 | A1 | 12/2006 | Herring | |
| 2007/0089347 | A1 | 4/2007 | Webber et al. | |
| 2007/0130817 | A1 | 6/2007 | Ballard | |
| 2007/0199225 | A1 | 8/2007 | Haugen | |
| 2008/0028662 | A1 | 2/2008 | Abraham et al. | |
| 2008/0092422 | A1 * | 4/2008 | Daniel et al. | 42/90 |
| 2008/0168695 | A1 | 7/2008 | Nakayama | |
| 2008/0190005 | A1 * | 8/2008 | Rohrauer | 42/75.01 |
| 2008/0216377 | A1 * | 9/2008 | Rohrauer | 42/75.01 |
| 2008/0236017 | A1 * | 10/2008 | Fitzpatrick et al. | 42/73 |
| 2009/0007477 | A1 * | 1/2009 | Robinson et al. | 42/75.02 |
| 2009/0277067 | A1 | 11/2009 | Gregg | |
| 2009/0288324 | A1 | 11/2009 | Peterson et al. | |

OTHER PUBLICATIONS

"Sako Export 2008", Sales Catalog, 2008, Sako Ltd, available at http://www.sako.fi/pdf/sako_export_2008.pdf.

"Federal XC900;" retrieved on Jul. 9, 2009 from http://gunsync.com/view-prop.php?id=181&name+Federal-XC900; Jan. 3, 2007; one page.

"Timerwolf 338 Lapua", Webpage, Jun. 7, 2007, Colt Canada Corp., available at http://www.coltcanada.com/timberwolf-page.htm.

"Owner's and Maintenance Manual for SAKO TRG 22/42 Sharpshooting System", Owners's Manual, Aug. 19, 2007, Sako Ltd, available at http://www.sako.fi/pef/manuals/TRG22_42/pdf.

"Specification—Sako TRG Sharpshooting System", Specification, Aug. 19, 2007, Sako Ltd, available at http://www.sako.fi/pdf/specs/TRG.pdf.

"Hecate II: Long-Range Anti-Material Rifle", Sales Brochure, PGM Precision, available at http://www.pgmprecision.com/uploads/pdf/hecate_2008_en.pdf.

"A.M.S.D. Sniper Rifle", Specification, Apr. 21, 2006, Advanced Military System Design, available at http://www.amsd.ch/products/nemesis/om50nemesis.pdf.

"Sako Export 2008", Sales Catalog, Aug. 19, 2007, Sako Ltd, available at http://www.sako.fi/pdf/sako_export_2008.pdf.

"AW Rifle System", Sales Brochure, Accuracy International Ltd. (Apr. 7, 2006) available at http://www.accuracyintemational.com/assets/assets/aw_brochure.pdf.

"AICS (Accuracy International Chassis System) Upgrade Kit for Remington 700", Sales Brochure, Accuracy International Ltd. (Apr. 7, 2006) available at http://www.accuracyinternational.com/assets/assets/aics_brochure.pdf.

"Timberwolf 338 Lapua", Webpage, Colt Canada Corp. (Jun. 25, 2007) available at http://www.coltcanada.com/timberwolf-page.htm.

"Colt Canada", Sales Catalog, Colt Canada Corp. (Feb. 21, 2008) available at http://www.coltcanada.corn/PDF%20/Forms/CC-cat-web.pdf.

"Owner's and Maintenance Manual for SAKO TRG 22/42 Sharpshooting System", Owners Manual, Sako Ltd (Sep. 2, 1993) available at http://www.sako.fi/pdf/manuals/TRG22_42.pdf.

"Specification—Sako TRG Sharpshooting System", Specification, Sako Ltd. (Sep. 28, 2001) available at http://www.sako.fi/pdf/specs/TRG.pdf.

"Specification—Sako TRG Sharpshooting System", Specification, Sako Ltd. (Dec. 19, 2008) available at htip://www.sako.fi/pdf/specs/TRG.pdf.

"Hecate II: Long-Range Anti-Material Rifle", Sales Brochure, PGM Precision (Dec. 12, 2008) available at http://www.pgmprecision.com/uploads/pdf/hecate_2008_en.pdf.

"A.M.S.D. Sniper Rifle", Specification, Advanced Military System Design (Apr. 21, 2006) available at http://www.amsd.ch/products/nemesis/om50nemesis.pdf.

"Sako Export 2008", Sales Catalog, 2008, Sako Ltd. (Apr. 1, 2008) available at http://www.sako.fi/pdf/sako_export_2008.pdf.

"JP MOR-07 Manually Operated Rifle", Webpage, J.P. Enterprises, Inc. (Jan. 5, 2007) available at http://www.jprifles.com/1.2.6.php.

"MBAR", Webpage, Halo Arms, LLC (Dec. 12, 2006) available at http://www.haloarms.com/MBAR.html.

"MP-MODSS (McreesPrecision Modular Stock System)", Webpage, McCree's Multi Services (Aug. 16, 2007) available at http://www.mcreesprecision.netlindex.htm.

(56) References Cited

OTHER PUBLICATIONS

"A.R.M.S. #50 M-CV, and #58 M-CV MOD SIR System", Sales Brochure, A.R.M.S., Inc. (Nov. 5, 2009) available at http://www.armsmounts.com/manuals/50M-CV %20Manual.pdf.

Remington Arms Company, Inc., "Remington Law Enforcement 2007 Catalog", 2007, 37 Pages.

* cited by examiner

TACTICAL FIREARM SYSTEMS AND METHODS OF MANUFACTURING SAME

CROSS-REFERENCE TO RELATED APPLICATION & PRIORITY CLAIM

This application claims priority to and the benefit of: (1) U.S. Provisional Patent Application No. 60/979,301, filed 11 Oct. 2007; and (2) U.S. Provisional Patent Application No. 61/100,788, filed 29 Sep. 2008. Both of said provisional patent applications are incorporated herein by reference in their entireties as if fully set forth below.

TECHNICAL FIELD

The various embodiments of present invention relate generally to firearms and more particularly to user-configurable weapons platforms that are modular, bedding-less adaptive, and retractable foldable stock. In addition, various embodiments of the present invention relate to various features capable of being used in concert with various firearms weapons platforms and methods for the provision of tactical weapons platforms.

BACKGROUND

Since the beginning of the modern age of firearms (e.g., rifles), the construction of firearms have been essential to providing long range accuracy. This is most evident looking at the historical evolution of the handgun to the rifle that allowed shooters to extend their range of engagement for personal defense, hunting, target competition, and warfare.

Today's tactical or multi-purpose rifles must adapt to a variety of shooters in adverse environments, conditions, terrains, operational scenarios, and competitive marksmanship events. For example, rifle stocks must be configurable to meet the physical body types of shooters, supplemental equipment (e.g., one or more accessories), demands of the type of shooting performed, and preferences of individual shooters. Fundamental elements of all weapons platforms include, for example, actions, chasses, and stocks.

The vast majority of designs, especially those for bolt action rifle weapon platforms, have not changed much over the last 50 years. Essentially most rifle stocks are derived in one form or another from target shooting stocks. Some are made lighter and thinner for hunting and others made thicker and heavier for competition. Traditionally made of wood, rifle stocks are the furniture that barreled action receivers are mounted into. Today, wood rifle stocks are being improved with aluminum pillars, epoxy bedding compounds, or simply being totally manufactured of fiberglass, or other composites, all in an effort to sustain or increase accuracy and durability.

While serving their respective purposes, traditional rifle stocks do possess drawbacks. Wood is obviously very beautiful, plentiful, and relatively inexpensive (in utility grades); however it is quite susceptible to damage. Indeed, it will readily absorb water, and is adversely affected by extremes in temperature. Bedding compounds have been brought about as a way to provide a stable "bed" or interface of synthetic material that is less affected by temperature extremes and help to improve accuracy. Bedding, however, must be installed by a qualified gunsmith, maintained and repaired over time, and is affected by cleaning solvents, chemicals, moisture, rough handling and temperature extremes. Fiberglass or composite stocks are much better rifle stocks for protection against the elements, heat & cold and take bedding compounds well. These types of stocks are expensive, are single purpose, not ergonomically friendly, custom manufactured primarily as an aftermarket item, and suffer from perhaps the largest and most significant drawback—the basic design is still essentially that of a target shooting stock. Rifle shooting disciplines are so many and varied that the traditional rifle stock needs to evolve with the modern applications of the rifle for long range tactical shooting.

Even newer stock innovations in the rifle industry maintain a steadfast hold on the target shooting design legacy. While innovations in materials and improvements in ergonomics indicate that some progress is being made, it is evident that the rifle stock is not being considered as part of an integrated rifle system platform.

What is needed, therefore, are modular user configurable tactical rifles that can be adapted to meet a variety of environmental, operational, and user preference requirements. In addition, what is needed are various types of user-friendly accessories that can aid in providing a weapons platform capable of being configured in many manners. It is to the provision of such tactical rifles, user-friendly accessories, and associated manufacturing methods that the various embodiments of the present invention are directed.

BRIEF SUMMARY OF EXEMPLARY EMBODIMENTS

Briefly described, some embodiments of the present invention can be directed to a rifle stock assembly. A rifle stock assembly can generally include a forend assembly, a receiver assembly, and butt stock assembly. The forend assembly can be adapted to house a portion of a barrel. A receiver assembly can be configured to be detachably coupled to the forend assembly. The receiver assembly can be adapted to interface with a bolt action. The butt stock assembly can be configured to be detachably coupled to the receiver assembly.

A rifle stock assembly can also include other features. For example, a forend assembly and a receiver assembly can be configured to be detachably coupled by a first fastener. Also, a forend assembly can be configured to form a sleeve surrounding at least a portion of a barrel. The forend assembly can also be configured such that forend assembly does in physical contact with the barrel. The receiver assembly can comprise a cavity, the forend assembly can comprise a projection, and the projection can be configured to be inserted into the cavity to couple the forend assembly to the receiver assembly. Also, the projection can be secured within the cavity by a fastener. The receiver assembly can be adapted to interface with a bolt action without a bedding material. And the receiver assembly can comprise a bay contoured to directly interface with a bolt action.

As another feature example of some embodiments, a rifle stock assembly can include a connecting element. The connecting element can couple a forend assembly to a receiver assembly and serve as an interface member between the forend assembly and receiver assembly. The interface enables the forend assembly to not be in physical contact with the receiver assembly. In addition, the receiver assembly can comprise a cavity, the connecting element can comprise a projection and a rim, and the projection adapted to be inserted into the cavity and the rim adapted to be inserted into interior portion of the forend assembly.

Still yet other features can be incorporated with a rifle stock assembly according to the various embodiments of the present invention. For example, a rifle stock assembly can include a hinge. The receiver assembly and the butt stock assembly can be detachably coupled by a hinge. In addition, the butt stock assembly having a longitudinal axis, the longitudinal axis aligned below the hinge. As another example, a rifle stock assembly can include one or more rails (or rail attachment surfaces). A first rail can be adapted to couple to a top portion of a forend assembly and a top portion of an action and the action can be coupled to the receiver assembly. The rail can extend substantially the length of the forend assembly and action. Also, a second rail can be coupled to a side portion of the forend assembly and a third rail can be coupled to a bottom portion of the forend assembly. The forend assembly can comprise a first mounting area for coupling the second rail to the forend assembly parallel to the barrel and a second mounting area for coupling the second rail to the forend assembly parallel to the barrel.

In accordance with another embodiment, a modular stock assembly for a bolt action rifle can generally comprise a forend, a receiver, and a butt stock. The forend assembly can have a body adapted to house a barrel in a free floating configuration. The body can be configured to surround at least a portion of the length of the barrel. The receiver assembly can be detachably coupled to the forend assembly and adapted to directly interface with a bolt action without a bedding. The butt stock assembly can be detachably coupled to the receiver assembly by a hinge. A bolt action rifle can also comprise a first rail coupled to a top portion of the forend assembly and to a top portion of an action. The action can be coupled to the receiver assembly, and the rail can extend substantially the length of the forend assembly and action.

In accordance with yet another embodiment, a modular stock assembly for a bolt action rifle can generally comprise one or more forends, receivers, and butt stocks. For example, a modular rifle stock assembly system can comprise: a first forend assembly adapted to house a portion of a barrel; a second forend assembly adapted to house a portion of a barrel; a first receiver assembly adapted to detachably couple to the first forend assembly and the second forend assembly, the first receiver assembly adapted to interface with a first bolt action; a second receiver assembly adapted to detachably couple to the first forend assembly and the second forend assembly, the second receiver assembly adapted to interface with a second bolt action; a butt stock assembly adapted to detachably couple to the first receiver assembly and the second receiver assembly. A modular stock assembly can also include a second butt stock assembly adapted to detachably couple to the first receiver assembly and the second receiver assembly.

Other aspects and features of embodiments of the present invention will become apparent to those of ordinary skill in the art, upon reviewing the following description of specific, exemplary embodiments of the present invention in conjunction with the accompanying figures. While features of the present invention may be discussed relative to certain embodiments and figures, all embodiments of the present invention can include one or more of the advantageous features discussed herein. Indeed, while one or more embodiments may be discussed as having certain advantageous features, one or more of such features may also be used in accordance with the various embodiments of the invention discussed herein. Also, while discussion contained herein may, at times, focus on rifle-type weapons platforms, embodiments of the present invention can also be used with various other weapons platforms. In similar fashion, while exemplary embodiments may be discussed herein as device, system, or method embodiments, it should be understood that such exemplary embodiments can be implemented in various devices, systems, and methods even thought not discussed in such embodiments.

DETAILED DESCRIPTION OF PREFERRED & ALTERNATIVE EMBODIMENTS

Figure 1A:
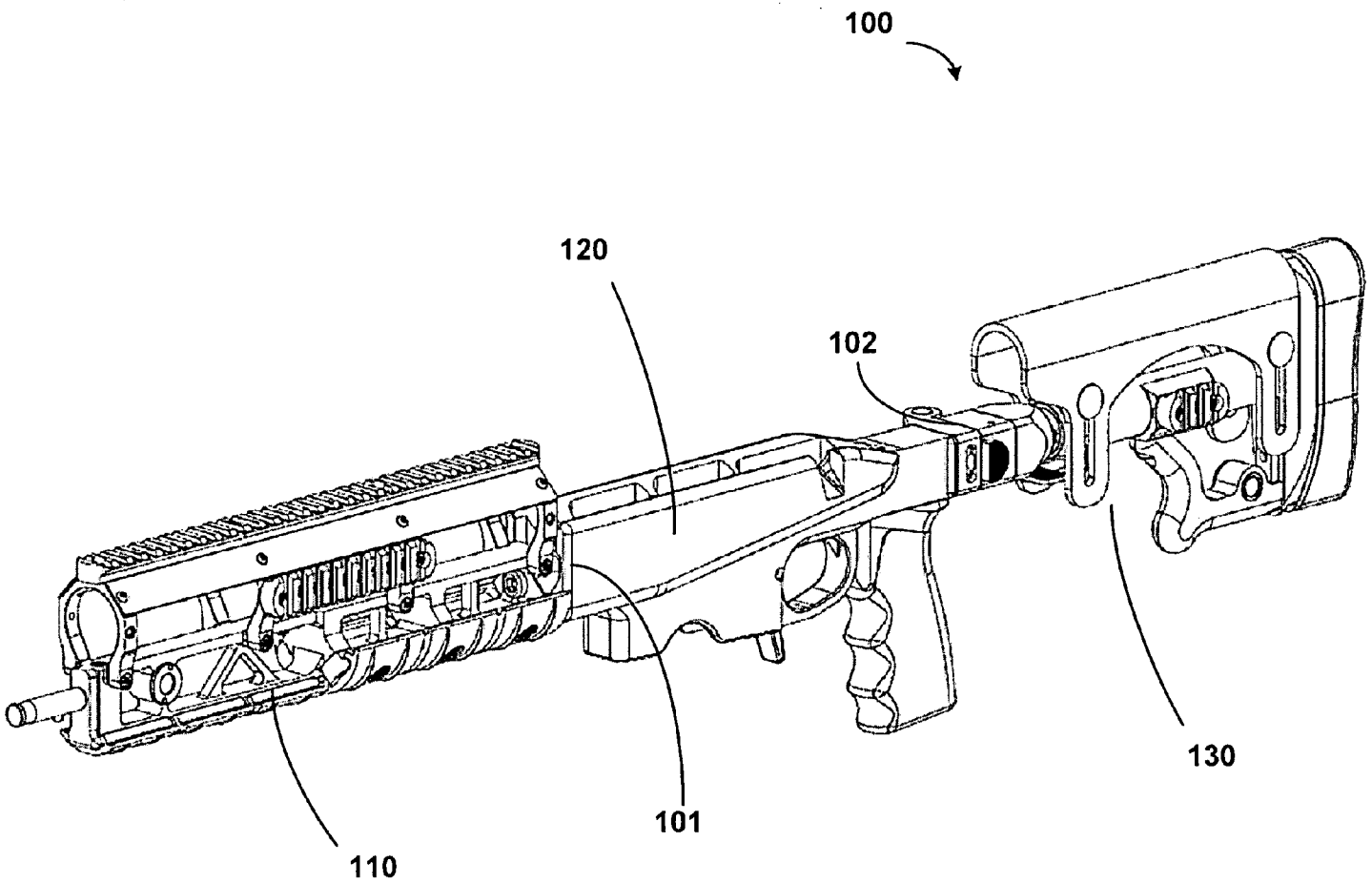
FIG. 1A illustrates a perspective view of a tactical firearm system in accordance with some embodiments of the present invention.

To facilitate an understanding of the principles and features of the various embodiments of the present invention, various illustrative embodiments are explained below. Indeed, embodiments of the present invention are described below for providing tactical weapons platforms capable of being configured for various user requirements. Embodiments of the invention, however, are not so limited. Rather, embodiments of the present invention can incorporate one or more accessories for implementation in a tactical weapons platform. For example and not limitation, embodiments of the present invention may be provided as one or more of: a modular stock chassis system, an improved long-range bolt action rifle platform, a thermal heat mirage management system for use with a weapons platform, a weapons platform comprising modular forends, a weapons platform comprising a composite forend construction, a weapons platform comprising a versatile buttstock body, a weapons platform comprising a multi-threaded monopod, a length of pull mechanism to aid in providing a user-configurable weapons platform, a weapons platform comprising a modular, adjustable grip handle, and a weapons platform comprising a truss-type configured forend.

Various embodiments of the present invention are directed to modular adaptive tactical stocks (e.g., rifle stocks). Such stocks can include ergonomic enhancements and modular interchangeable components that can be configured to particular environmental, operational and accessory requirements. Tactical rifle stocks according to some embodiments of the present invention can comprise a butt stock assembly; lower receiver assembly; an adjustable pistol grip assembly; and multiple free-floating barrel forend assemblies. These subassembly components of a tactical rifle stock are preferably modular, adjustable, and easily interchangeable. Interchangeable subassemblies enable tactical rifle stocks to accommodate either left or right handed operation, custom, or commercial rifle receivers, or a variety of configurations and a broad range of accessories.

Embodiments of the present invention were conceived and developed as a modular stock chassis system and as the basis for an integrated rifle platform to support the broadest range of rifle shooting applications. Embodiments of the present invention provide users with an adaptive, lightweight, entirely modular, ergonomically adjustable, user configurable, folding, and retractable rifle stock chassis system for shoulder fired weapons and rifles. Embodiments of the present invention can be configured for left or right handed operation by simply changing a modular lower receiver and a locking hinge joint.

Exemplary embodiments of the present invention include an adjustable folding-retractable stock. The adjustable folding-retractable stock provides users with a high level of operational flexibility, compactness, maneuverability, and transportability. Embodiments of the present invention can be carried, manipulated, and used with the butt stock in the folded and sling carry positions. The adjustable folding-retractable stock provides users with a tool-less ability to rapidly change the length of pull (LOP), even with gloved hands using a cam lock throw lever to accommodate users wearing thinner or thicker clothing, vests or body armor. Users can easily open and close the folding-retractable stock assembly with gloved hands utilizing a single button control.

Exemplary embodiments of the present invention include a modular butt stock configuration. Rifle shooters are generally physically different, and the invention allows users to adjust the butt pad (recoil pad) up and down to better fit into his shoulder pocket. With changing environments, events, or missions shooters can opt for either a butt-hook stock configuration or a butt stock mounted, retractable monopod that provides variable height adjustment of the butt-stock in field situations. The monopod can also be used for a non-shooting hand multi-positional grip to aid in sustaining accuracy in unconventional shooting positions.

Exemplary embodiments of the present invention include an adjustable hand grip. The adjustable hand grip provides the shooter with multiple grip angle mounts for shooter comfort, enhanced handing under different shooting positions improving accuracy. The hand grip is adjustable between the web of the shooting hand and pad of the trigger finger with one screw.

Exemplary embodiments of the present invention employ an innovative rail attachment system (e.g., a Picatinny rail attachment system). The 1913 spec Picatinny Rails can be designed with a convex bearing surface mating to a complementary concaved mounting surface such that, when tightened down, the rails lock more rigidly and securely to the attachment points contributing to overall system rigidity. Intelligent use of Picatinny Rails supports a complete optics and electro-optics suite of equipment to include: optical day sight, night sight, laser range finder, laser illuminator, laser pointer, thermal imager, integrated day/night sight, visible light, GPS, and various other sensors.

In an exemplary embodiment, a lower receiver assembly is designed to accommodate a wide range of barreled action receivers employing a commercial detachable box magazine. In alternative embodiments, a lower receiver assembly can be interchanged with another lower receiver assembly designed for a high capacity detachable box magazine using an original or another barreled action.

In an exemplary embodiment, a butt stock assembly preferably has multiple stock configurations, including adjustable folding-retractable and fixed-adjustable butt stocks. The retractable configuration of the stock preferably enables varying the LOP to accommodate various types of clothing (e.g., equipment vests and winter jackets) and also adjusts for varying body types and sizes of individual shooters. The adjustable folding-retractable stock preferably provides users with a high level of ergonomic fit, compactness, maneuverability, and transportability. A cam-locking device enables the butt stock assembly to be shortened or lengthened as desired by users. The locking hinge joint preferably can be easily unlocked and folded by a gloved hand.

In an exemplary embodiment, the pistol grip assembly preferably can be comprised of a commercially off-the-shelf M16 style grip. This grip can incorporate an advanced variable angle hand grip adjustment feature that enables the shooter to select an ergonomic grip angle for a variety of shooting positions, enhancing accuracy, ergonomic gun fit, and functionality. Contemplated embodiments of the invention include a multi-axis hand grip.

In an exemplary embodiment, the lower receiver assembly is designed to receive the barreled action upper receiver directly, employing a bedding-less design technology without the need for an interface bedding material to assure accuracy. This significantly reduces maintenance and makes the rifle less susceptible to bedding failure caused by age, temperature extremes, moisture, cleaning solvents, and/or rough handling.

In an exemplary embodiment, the rifle stock system preferably employs multiple flush cup sling mounting points on the folding butt-stock, lower receiver, and forends. Flush cup sling attachment positions have been designed so that the rifle can be operated ambidextrously or deployed from the slung position.

Various exemplary embodiments of the forend assembly employ multiple forend designs including: Picatinny rail free floating; squared target; tapered field; power cell; and power cell electro-optic. Forend assemblies can be selected according to the shooting conditions, events, operational requirements and user preferences for the shooting activity.

In still yet other embodiments, a tactical rifle stock includes a modular lower receiver. Indeed, various exemplary embodiments of the modular lower receiver accommodate a variety of barreled action configurations. These preferably include but are not limited to actions from Remington, Surgeon, Stiller, BAT, GA Precision, SAKO, Savage, and others. Barrel types, sizes, and contours for tactical rifles may be selected based upon operational requirements all of which can be implemented as free floating in accordance with embodiments of the present invention.

In an exemplary embodiment, a tactical rifle stock assembly includes a modular receiver that accommodates a standard five round detachable box magazine and an interchangeable lower receiver that accommodates a high capacity detachable box magazine accommodates both SAAMI CIP and longer length specification ammunitions. This high capacity detachable box magazine design is a double-to-single stack magazine with precision integrated angular cartridge de-stacking rails that manage the reliable feeding of the cartridges into the chamber.

As discussed and illustrated herein, with reference to exemplary embodiments of the present invention, various embodiments can be used to provide a user-friendly, easy to configure weapons platform. The below discussion, while provided in various sections, is to be read as a whole and applies to this entire disclosure and the various discussed embodiments. Discussion of one or more features in a certain section or embodiment can also be pertinent to other features and embodiments discussed in one or more other sections. In addition, while the claims of this application may be directed to one or more features described herein, this entire disclosure provides context to the appended claims, which may be directed to only certain features described herein.

Modular Stock Chassis System & Receiver

FIG. 1A illustrates an exemplary embodiment of a tactical rifle stock assembly 100 of the present invention. In accordance with an exemplary embodiment, the tactical rifle stock assembly 100 can comprise several sub-assembly components: a forend assembly 110; a receiver assembly 120; and a butt stock assembly 130. The assemblies 110, 120, and 130 are preferably modular and interchangeable. This enables the tactical rifle stock assembly 100 to be configured to accommodate either left or right handed users. Additionally, the modularity of the assemblies 110, 120, and 130, in particular the ability to interchange the receiver assembly 120, enables the tactical rifle stock assembly 100 to accommodate custom or commercial barreled rifle actions. The modularity of the assemblies 110, 120, and 130 also allows users to customize the tactical rifle stock assembly 100 for different tactical applications, accessories, or sub-systems.

Each forend assembly 110 design can be coupled to each receiver assembly 120 through a front assembly interface 101. Similarly, each receiver assembly 120 can be coupled to each butt stock assembly 130 through a rear assembly interface 102. Therefore, a number of embodiments of the tactical rifle stock assembly 100 are contemplated, each having a different combination of assemblies 110, 120, and 130.

There are a variety of contemplated embodiments of the forend assembly 110 design. For example, the forend assembly 110 may employ, but is not limited to, any of the following designs: Picatinny Rail Free Floating; Squared Target; Tapered Field; Power Cell; and Electro-Optic Power Cell. Various features of the embodiments of the forend assembly 110 are discussed in greater detail below.

A forend assembly 110 can be easily substituted by users for a different forend assembly 110 design. The forend assembly 110 can preferably be detached from the receiver assembly 120 by using simple hand tools. This feature enables a user to change a forend assembly 110 to accommodate different barreled actions, tailor-fit the forend 110 to a user's body size or shooting style, or customize the forend assembly 110 for one or more tactical applications. For example, if a user desires an action with a different barrel for a different application, a different forend assembly 110 (i.e., larger, smaller, different geometry) can be coupled to the receiver assembly 120. Similarly, if the user desires to mount a large number of accessories to the forend assembly 110, a forend assembly 110 having a large number of rails and mounting positions can be selected and coupled to the receiver assembly 120.

As mentioned, the receiver assembly 120 can interface with a number of different actions. One receiver assembly 120 can interface with numerous different actions or a receiver assembly 120 may be custom designed to interface with only one type of action. The receiver assembly 120 for a tactical rifle stock assembly 100 can be selected based upon the type of action the user desires to employ. For example, the receiver assembly 120 may interface with, but is not limited to, any of the following actions (left or right handed operation): Surgeon Short Action Repeater; Remington 700 Short Action; TRG-22, Surgeon XL Repeater; and Remington 700 Long Action, Remington 700 Long Action Magnum, SAKO TRG-42, and others.

The forend assembly 110, receiver assembly 120, and butt stock assembly 130 of the tactical rifle stock assembly 100 are preferably constructed at least in part from 7075 T6 aluminum alloy. The aluminum alloy components of the assemblies 110, 120, and 130 are preferably precision machined and/or EDM wire cut from a heat-treated forged billet. In other contemplated embodiments the assemblies 110, 120, and 130 can be constructed from different metals or alloys such as 6061 aluminum, nickel, nickel alloy, titanium, titanium alloy, magnesium, magnesium alloy, amorphous metal, or another suitable metal or alloy. In further contemplated embodiments, the assemblies 110, 120, and 130 can be constructed in whole or in part from a nonmetallic material such as fiberglass, carbon fiber, or another suitable composite or polymer materials.

The tactical rifle stock assembly 100 is preferably designed to be lightweight. In other contemplated embodiments, the assemblies 110, 120, and 130 may be constructed from a material other than an aluminum alloy to further increase strength and reduce weight. For example, the assemblies 110, 120, and 130 can be constructed in whole or in part from a nonmetallic material such as fiberglass, carbon fiber, injection molded composites, magnesium, structured nano-materials, or other suitable composite or polymer materials.

Figure 1B:
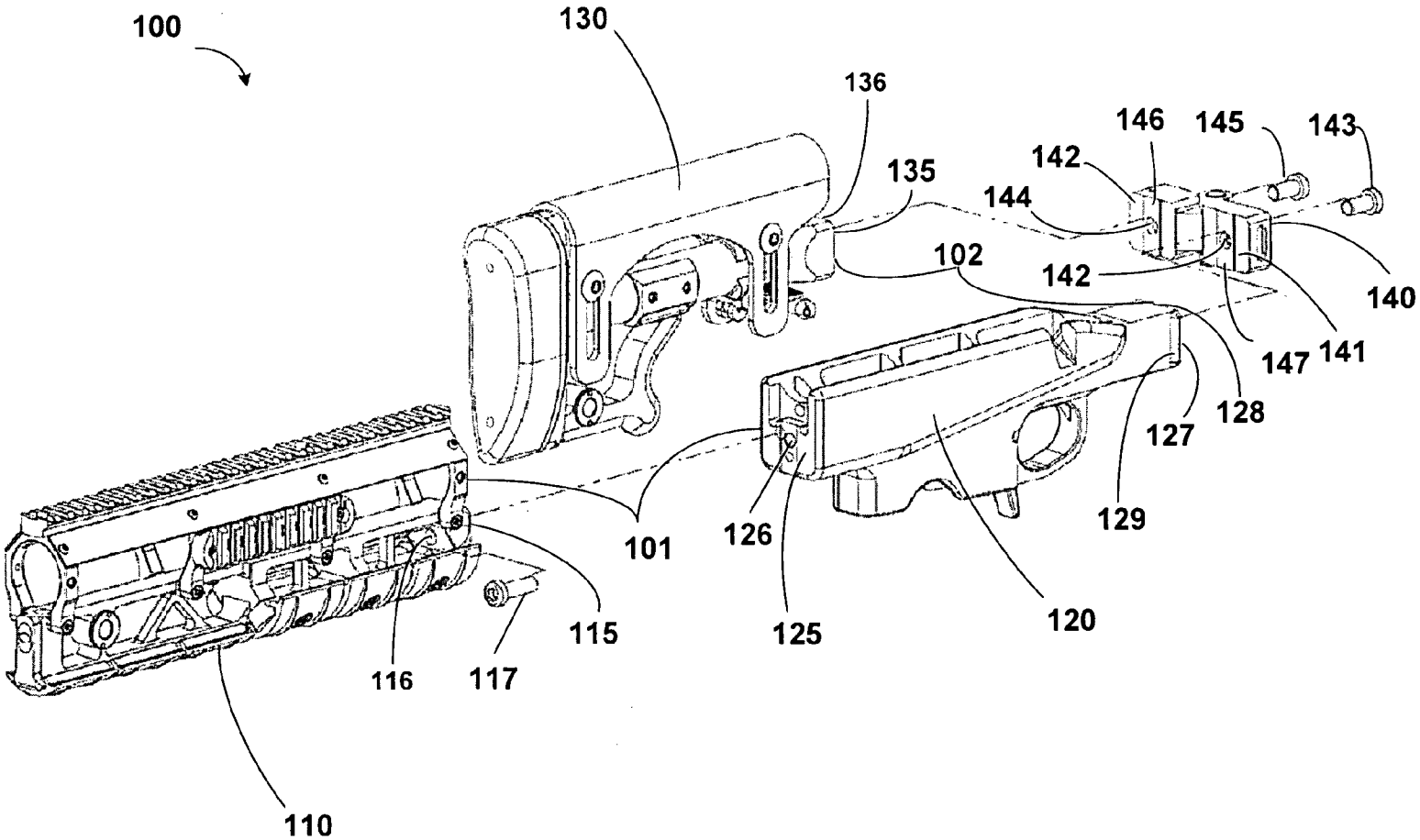
FIG. 1B illustrates an exploded view of the tactical firearm system in accordance with some embodiments of the present invention.

FIG. 1B illustrates separated assemblies 110, 120, and 130 of an exemplary embodiment of the tactical rifle stock assembly 100. The forend assembly 110 can couple to the receiver assembly 120 at the front assembly interface 101. The front assembly interface 101 can comprise a forend surface 115 and a front receiver surface 125. The forend surface 115 and front receiver surface 125 are preferably precision machined to be substantially negatives of each other (i.e., have corresponding surfaces). The forend surface 115 can comprise a male portion or segment designed to mate into a corresponding female segment on the front receiver assembly 125. The forend surface 115 can be joined to the front receiver surface 125 such that the forend assembly 110 and receiver assembly 120 are substantially fixed relative to each other. The forend surface 115 and the receiver surface 125 can be brought into contact to join the assemblies 110 and 120 by hand, without the use of tools.

In other contemplated embodiments, the forend surface 115 may comprise a segment designed to vertically slide into a groove in the front receiver surface 125. For example, the forend surface 115 may comprise a projection and the front receiver surface 125 may comprise a complementary groove. Other coupling configurations have also been contemplated for the forend surface 115 and front receiver surface 125, such as a sliding dovetail joint.

The forend surface 115 can comprise a through bore 116 spanning the forend receiver surface 115 and a portion of the truss work of the forend assembly 110. The front receiver surface 125 may comprise a first receiver bore 126 extending into the body of the receiver assembly 120. The through bore 116 and the first receiver bore 126 are preferably coaxially aligned when assemblies 110 and 120 are joined. A first assembly fastener 117 can be inserted through the through bore 116 and engage the interior of receiver bore 126. The fastener 117 preferably rotationally engages the interior of receiver bore 126 to secure the forend assembly 110 to the receiver assembly 120. The fastener 117 can be a bolt having a common thread pattern to allow for easy replacement if it is lost or damaged. In other contemplated embodiments, the fastener 117 can have a precisely selected thread pattern to allow for precision tightening of the fastener 117 to a desired degree of torque. The fastener 117 can preferably be hand tightened by the user using a simple tool such as an allen wrench or socket wrench.

The butt stock assembly 130 can couple to the receiver assembly 120 at the rear assembly interface 102. The butt stock assembly 130 and the receiver assembly 120 are preferably coupled by a hinge 140. The hinge 140 preferably enables the butt stock assembly 130 to translate from an extend position to a folded position relative to the receiver assembly 120. In the extended position, the butt stock assembly 130 can be oriented inline with the receiver assembly 120. This orientation corresponds to a traditional stock configuration. In the folded position, the butt stock assembly 130 can swing horizontally about the hinge 140 to a position parallel to and adjacent the receiver assembly 120. The position of the butt stock assembly 130 can be easily selected by a user based on preference or tactical need. The butt stock assembly 130 can swing to the left or to the right relative the receiver assembly 120 based upon the embodiment of the hinge 140 employed in the tactical rifle stock assembly 100. The configuration and structural details of the embodiments of the hinge 140 will be discussed in greater detail below.

The receiver assembly 120 can comprise a rear receiver surface 127. Similarly, the butt stock assembly 130 can comprise a front butt stock surface 135. The hinge 140 can comprise a front hinge surface 141 and a rear hinge surface 142. The rear receiver surface 127 can correspond in shape and area to the front hinge surface 141. The rear receiver surface can comprise a first shoulder 129 and a second shoulder (not pictured) on the sides of the receiver assembly 120 to extend the width of the rear receiver surface 127 to match that of the front hinge surface 141. Similarly, the front butt stock surface 135 can correspond in shape and are to the rear hinge surface 142.

The front hinge surface 141 can comprise a front hinge projection 147. In an exemplary embodiment, the front hinge projection 147 can extend vertically the height of the front hinge surface 141. The front hinge projection 147 is preferably disposed in the center of the front hinge surface 141 and is approximately ⅓ the width of the front hinge surface. In other embodiments, the front projection can be shorter, wider, narrower, or offset from the center.

The rear receiver surface 127 can comprise a rear receiver groove 128. The rear receiver groove 128 is preferably substantially equal in height, width, and depth to the front hinge projection 147. The hinge 140 can be joined to the receiver assembly 120 by bringing the front hinge surface 141 in contact with the rear receiver surface 127 and inserting the front hinge projection 147 into the rear receiver groove 128. The insertion of the front hinge projection 147 in the rear receiver groove 128 can prevent the rear receiver surface 127 and front hinge surface 141 from rotating relative to each other. The receiver assembly 120 can comprise a rear lip (not pictured) that can extend from underneath the rear receiver surface 127 and can contact the bottom of the hinge 140 when the hinge is joined to the receiver assembly 120. The rear lip can further prevent rotation of the hinge 140 relative to the receiver assembly 120 when the two are joined.

The hinge 140 can comprise a first hinge through bore 142. The rear receiver surface 127 can comprise a corresponding second receiver bore (not pictured). The first hinge through bore 142 and the second receiver bore are preferably substantially coaxially aligned when the hinge 140 is joined to the receiver assembly 120. A first hinge fastener 143 can pass through the bore 142 and engage the second receiver bore to secure the hinge 140 to the receiver assembly 120. The fastener 143 can be of substantially the same type as fastener 117, and can preferably be hand tightened by the user using a simple tool such as an allen wrench or socket wrench.

The rear hinge surface 142 can be substantially similar in area and shape to the front hinge surface 141. The rear hinge surface 142 can comprise a rear hinge projection 146 that is substantially similar to the front hinge projection 147. The front butt stock surface 135 can comprise a butt stock groove 136 corresponding to the rear hinge projection 146 and substantially similar to the rear receiver groove 127. The hinge 140 can be joined to the butt stock assembly 130 by bringing the rear hinge surface 142 in contact with the front butt stock surface 135. The rear hinge projection 146 can be inserted into the butt stock groove 136 in substantially the same manner as described above with regard to projection 147 and groove 128. The projection 146 and groove 136 can prevent rotation of the hinge 140 relative to the butt stock assembly 130.

The hinge 140 can comprise a second hinge through bore 144. The butt stock assembly 130 can comprise a butt stock bore (not pictured). The second hinge through bore 144 and the butt stock bore are preferably substantially coaxially aligned when the hinge 140 is joined to the butt stock assembly 130. A second hinge fastener 145 can pass through the second hinge bore 144 and engage the butt stock bore to secure the hinge 140 to the butt stock 130. The fastener 143 can be of substantially the same type as fastener 117, and can preferably be hand tightened by the user using a simple tool such as an allen wrench or socket wrench.

Figure 1C:
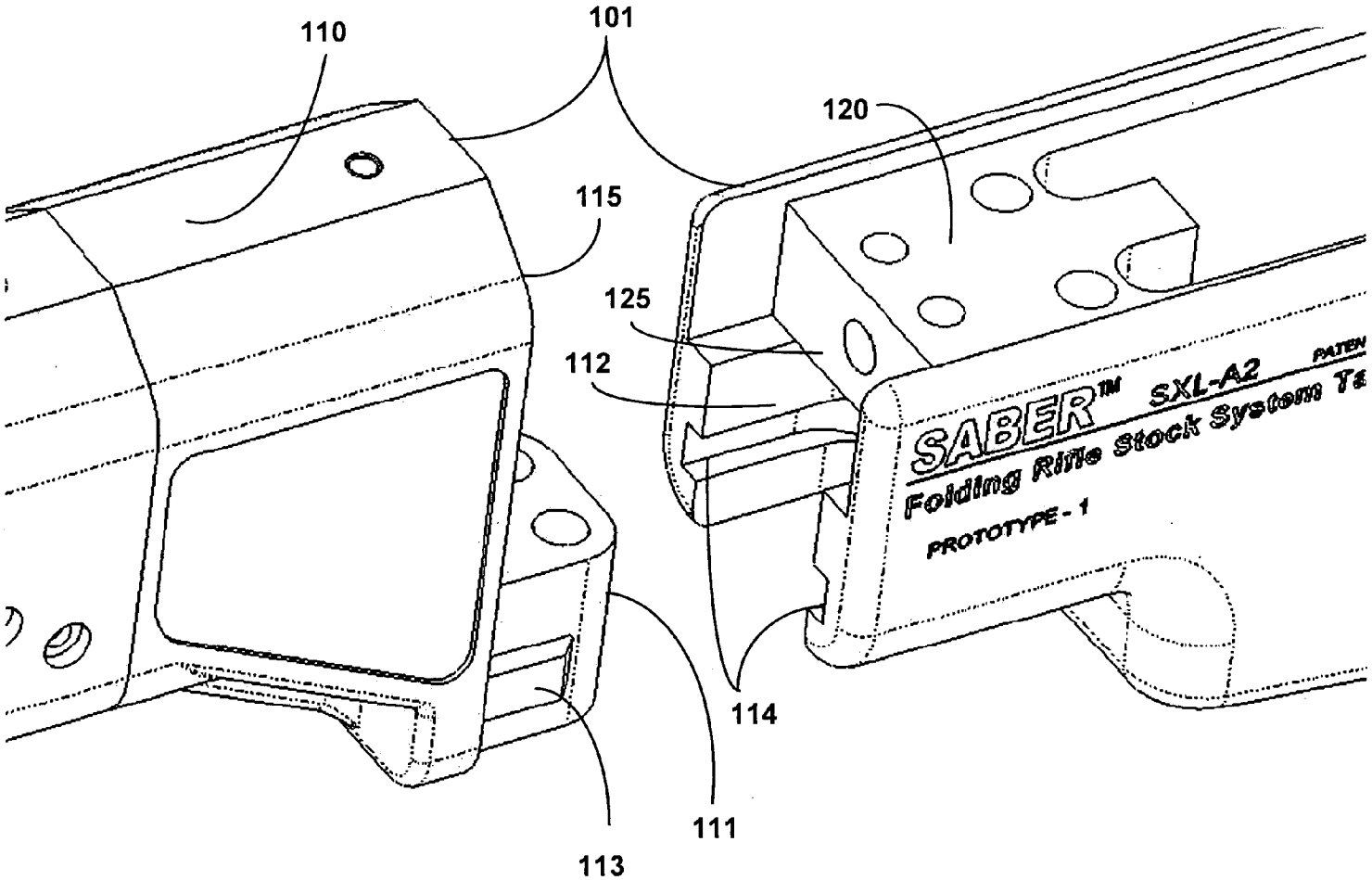
FIG. 1C illustrates a side view of an exemplary embodiment of a front assembly interface.

FIG. 1C illustrates a side view of an exemplary embodiment of a front assembly interface 101. In accordance with this exemplary embodiment, the forend surface 115 can comprise a forend projection 111. The projection 111 can comprise a pair of flanges 113 (one flange pictured) extending from the forend surface 115 along the projection 111. The front receiver surface 125 can comprise a cavity 112, and a pair of grooves 114.

The cavity 112 can correspond in shape and size to the projection 111. The forend 110 can be joined to the receiver 120 by bringing the forend surface 115 into contact with the front receiver surface 125, and inserting the projection 111 into the cavity 112. The flanges 113 can slide into the grooves 114. The projection 111 fitted into the cavity 112 prevents the forend assembly 110 from rotating relative to the receiver assembly 120.

Figure 1D:
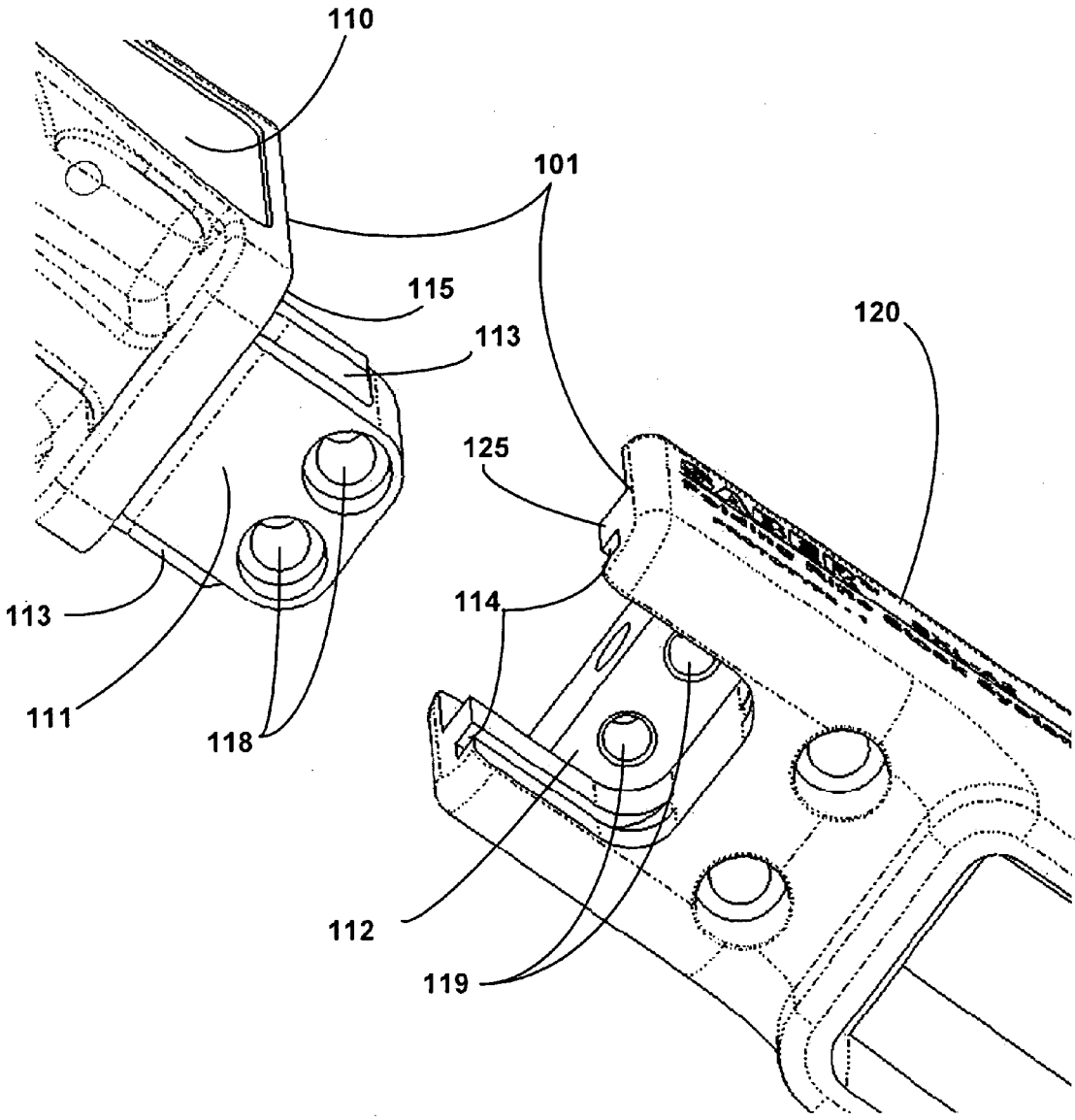
FIG. 1D illustrates a bottom view of an exemplary embodiment of a front assembly interface.

FIG. 1D illustrates a bottom view of an exemplary embodiment of a front assembly interface. The projection 111 can comprise through bores 118. The through bores 118 can vertically span the height of the projection 111. The receiver 120 can comprise receiver bores 119. The receiver bores 119 can be disposed vertically in a portion of the receiver 120 above the cavity 112. The through bores 118 and the receiver bores 119 can be coaxially aligned when the projection 111 is inserted into the cavity 112.

The forend assembly 110 can be secured to the receiver assembly 120 by passing two fasteners through the bores 118 and engaging bores 119. The fasteners prevent the projection 111 from sliding out of the cavity 112. The fasteners can be of substantially the same type as fastener 117, and can preferably be hand tightened by the user using a simple tool such as an allen wrench or socket wrench. In other contemplated embodiments, the fasteners can be counter-bored screws. In other contemplated embodiments, fewer or more bores may be employed in the projection 111 and the receiver assembly 120 to secure the forend assembly 110 to the receiver assembly 120.

The above description relating to the embodiment illustrated in FIGS. 1A and 1B demonstrates the modularity of the tactical rifle stock assembly 100. The forend assembly 110, receiver assembly 120, and butt stock assembly 130 can be easily coupled and detached from each other by a user by means of simple hand tools or the coupling may be tool-less. This feature enables users to quickly interchange assemblies based upon tactical need or personal preference. It also provides for easy replacement and upgrade of assemblies 110, 120, and 130 in the future. Modularity greatly improves the versatility of the tactical rifle stock assembly 100 and expands its operational applications.

Improved Long-Range Bolt Action Weapons Platform

Figure 2A:
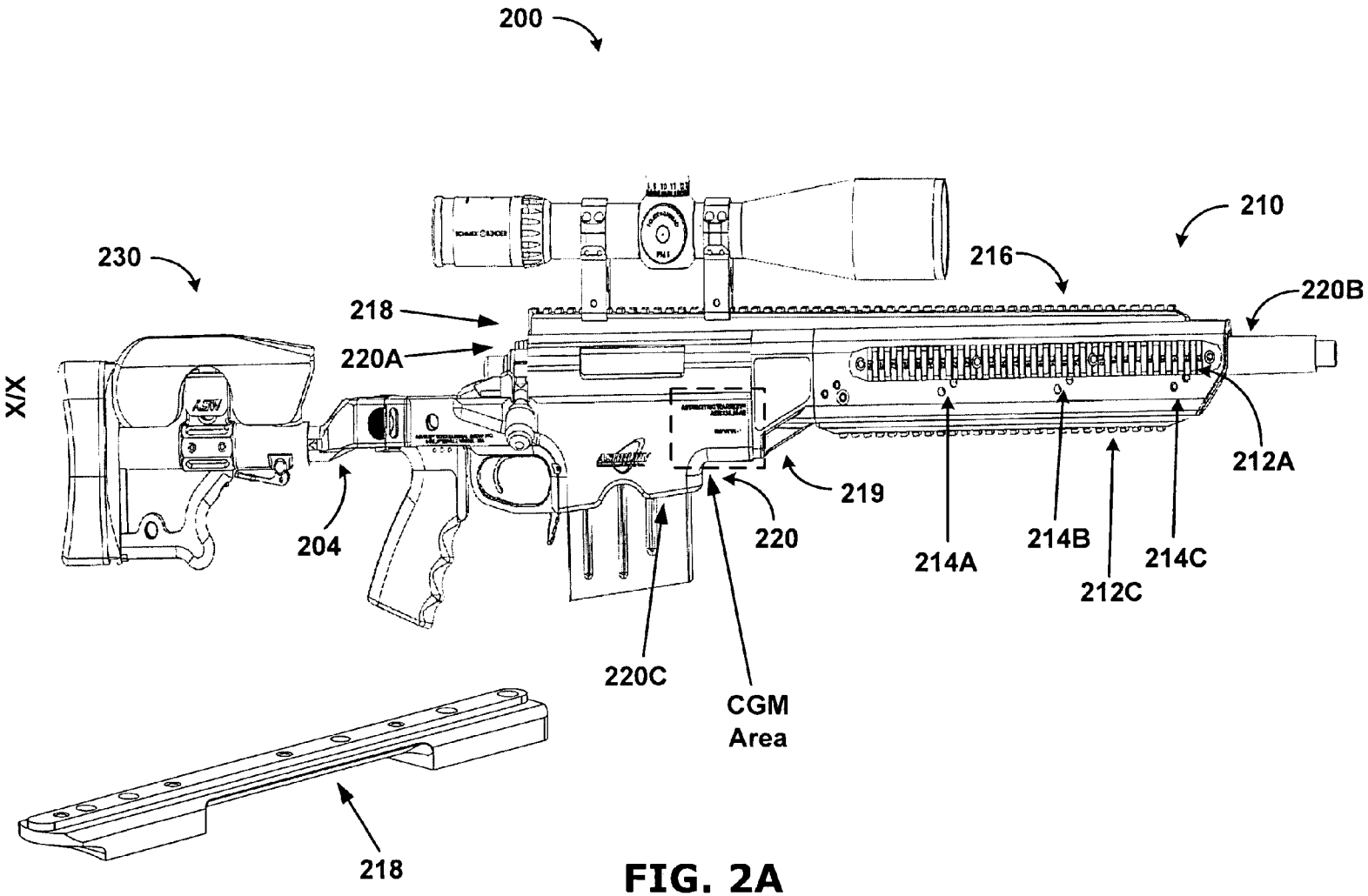
FIG. 2A illustrates a perspective view of an improved long-range bolt action weapons platform in accordance with some embodiments of the present invention.

FIG. 2A illustrates a perspective view of an improved long-range bolt action weapons platform 200 in accordance with some embodiments of the present invention. In this illustration, the weapons platform 200 is a bolt-action rifle. In other embodiments, the weapons platform 200 can be other types of firearms. In line with the above discussion, the weapons platform 200 can be comprised of several modular components. These modular components can generally include a forend portion 210 (or a forend), a receiver portion 220 (or a receiver), and a buttstock portion 230 (or buttstock or butt stock). Each of the forend 210, receiver 220, and buttstock 230 may also comprise one or more components making up the portions and/or accessory components. The forend 210 generally extends from the receiver 220 proximate a barrel of the weapons platform 200, the receiver portion 220 is generally positioned in a middle area of the weapons platform 200, and the buttstock 230 is generally positioned in a rear area of the weapons platform 200. The receiver 220 can include an action portion 220A, barrel portion 220B, and cartridge receiving portion 220C.

In currently preferred embodiments of the present invention, and as discussed herein, the forend 210, receiver 220, and buttstock 230 portions are configured as modular components. This feature enables the weapons platform 200 to be configured in accordance with user desires and also provides a weapons platform that is easily configurable. Indeed, the weapons platform 200 can be assembled and disassembled into its modular components as desired with no specialized, professional training. Currently known bolt-action rifles are not configured in modular fashion and do not comprise modular components. Rather, currently known bolt-action rifles are provided as integral weapons platforms not capable of being assembled and disassembled without specialized, professional training and retain their accuracy and reliability.

Modular weapons platforms, such as weapons platform 200, configured as a bolt-action rifle provides various advantageous features. For example, such modular configuration can enable utilization of one or more relocatable rail attachment surfaces (e.g., Picatinny rails), unitizing monolithic rails in various cants, unitizing monolithic rails and adapters for commercial receivers, custom actions, free floating enclosed forends, co-bore aligned mounts for electro-optics, multiple type field support attachments (e.g., tri-pod, bi-pod, mono-pod), and a bedding less body style (as discussed above).

Various such features are illustrated in FIG. 2A. For example, rail 212A can be provided as a relocatable rail attachment surface capable of being relocated at various positions and surfaces along an exterior surface of the forend 210. Similarly, rail 212B (not shown) can be provided on an exterior surface opposite the rail 212A and rail 212C can be provided on an underside surface of the forend 210. The rails 212A, 212B, 212C can be repositioned using various attachment points provided on the forend 210. In currently preferred embodiments, the rails 212A, 212B can be relocated and secured to different positions via a series of apertures disposed on an exterior surface of the forend 210. For example, and as shown in FIG. 2A, aperture series 214A, 214B, 214C are respectively collocated on the exterior surface of the forend. As shown, the aperture series 214A, 214B, 214C each comprise three apertures—with one aperture being covered by the rail 212A and two being exposed. Respective co-located apertures within the each of the aperture series 214A, 214B, 214C are preferably formed in a linear position such that the rail 212 can be mounted in a linear and parallel relationship with a bore axis of the weapons platform 200. The rails 212A, 212B, 212C can be provided to have multiple lengths as desired.

Another illustrated advantageous feature of the weapons platform 200 is the unitized monolithic rail 216. The unitized monolithic rail 216 may be a Picatinny 1913 spec rail and may also be chosen to be any other rail attachment surface as desired. As shown, the unitized monolithic rail 216 has a length that extends from a distal end of the receiver 220 proximate to a distal end of the forend 210. Due to the length of the unitized monolithic rail 216, it spans and unites the forend portion 210 and the receiver portion 220. An advantage of the unitized monolithic rail 216 includes increased rigidity of the weapons platform 200. Another advantage includes reduction of torsional flex of the weapons platform 200 when firing. In addition, the unitized monolithic rail enables improved recoil management.

In some embodiments, the unitized monolithic rail 216 can have advantageous interface characteristics between the forend 210 and the receiver 220. For example, the monolithic rail 216 may comprise one or more apertures spaced apart over its length. Mounting screws and/or lugs can be inserted in these apertures and also into respective mounting apertures in the forend 210 and the receiver 220. In currently preferred embodiments, one or more cylindrical recoil lugs can be used to attach the monolithic rail 216 to the forend 210 and/or the receiver 220. Recoil lugs enable the transfer of shock recoil away from utilized mounting screws 230 and onto the receiver 220 of the weapons platform 220. Such transformation of energy aids in dissipating and reducing recoil shock energy over the length and exterior surface of the weapons platform 200.

In some embodiments, an interface coupling 218 can be used. An interface coupling 218 can be used to provide an interface between the unitized monolithic rail 216 and the receiver 220. The interface coupling 218 is preferably shaped to be securedly attached to a top exterior surface of the receiver 220A. The interface coupling 218 can also be shaped to receive and securedly carry an underside surface of the unitized monolithic rail 216. The interface coupling 218 can also carry one or more recoil lugs that can be used for securedly affixing the unitized monolithic rail 216. An interface coupling 218 may not be necessary with all embodiments of the present invention, and may only be desired when utilizing certain commercially available receivers, for example.

Yet another feature of some embodiments of the present invention includes coupling the forend 210 to the receiver 220. In some embodiments, the forend 210 can be coupled to the receiver 220 via a connection portion 219. The connection portion 219 preferably has a plurality of apertures. The apertures are preferably capable of receiving securing mechanisms (e.g., screws, bolts, etc.) for securedly attaching the forend 210 to the receiver 220. In similar fashion, the receiver 220 preferably includes corresponding apertures to receive securing mechanisms for securedly holding the securing mechanisms.

Yet another feature of embodiments of the present invention relates to an improved center of mass region. As shown by the square, dashed-line box labeled "CGM Area," embodiments of the present invention can have a center of mass area situated in an area extending from the receiver to the receiver/forend interface. It should be understood that the exact center of mass will depend on many different variables; however, this the CGM Area is an approximate location for certain embodiments, such as the weapons platform provided in FIG. 2A. This improved center of mass region provides a balanced weapons platform that enables users to carry and transport the weapons platform.

Truss-Type Configured Forend Configuration

Figure 2B:
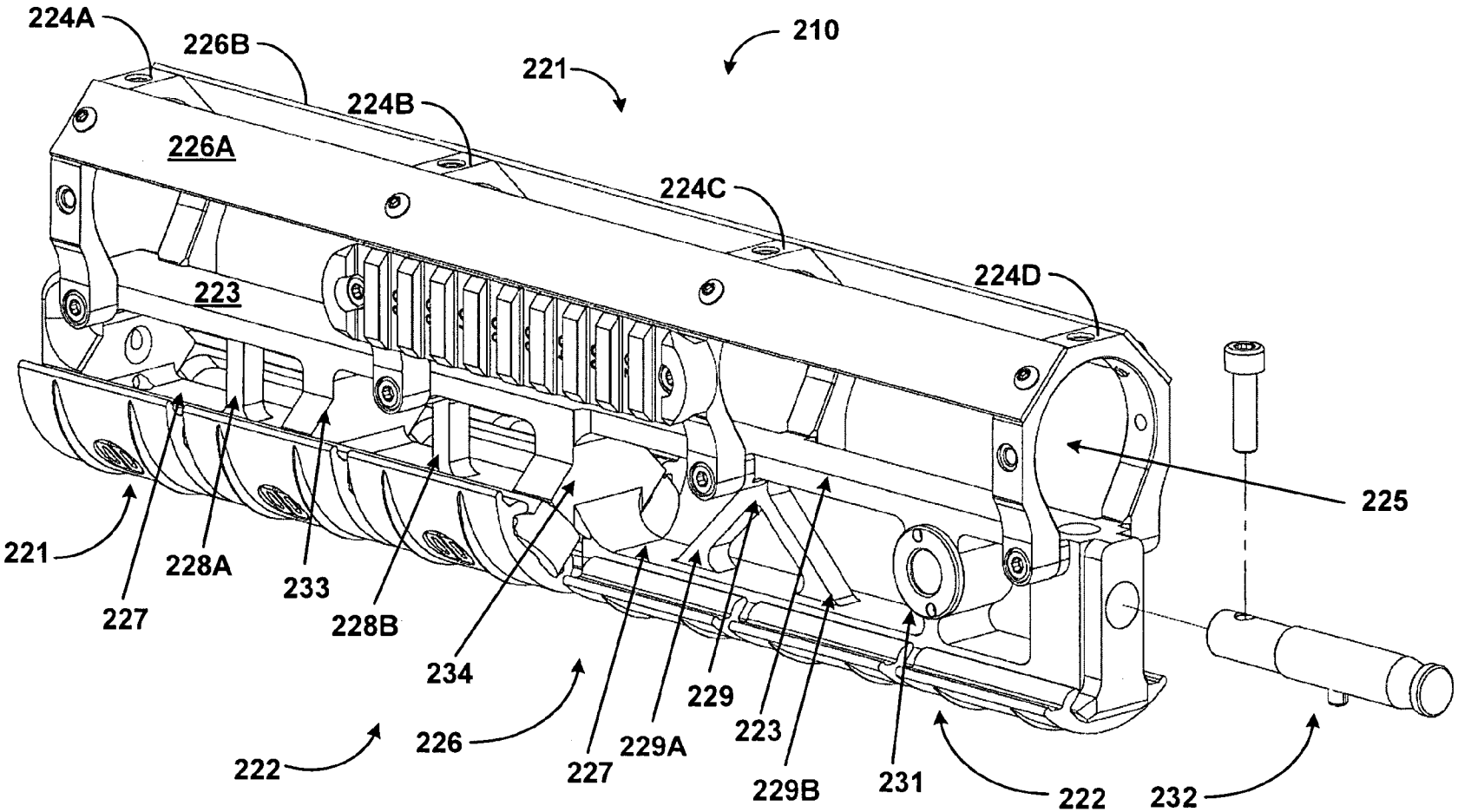
FIG. 2B illustrates a perspective view of a truss-type configured forend used in accordance with some embodiments of the present invention.
Figure 2C:
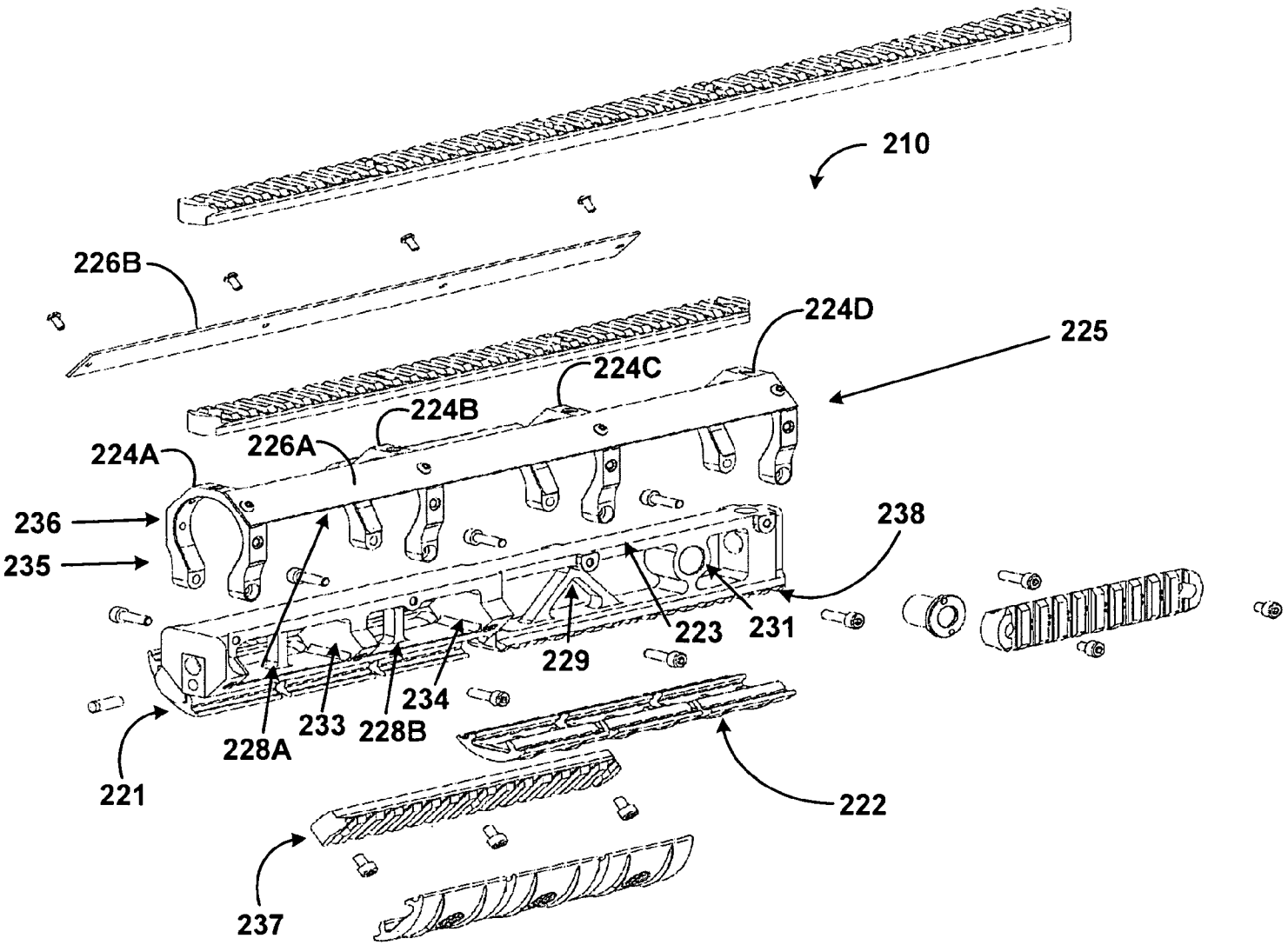
FIG. 2C illustrates an exploded view of a truss-type configured forend used in accordance with some embodiments of the present invention.

Other advantageous features of some embodiments of the present invention relate to a truss-type configured forend construction. FIG. 2B illustrates a perspective view of a truss-type configured forend 210 used in accordance with some embodiments of the present invention. FIG. 2C illustrates an exploded view of a truss-type configured forend 210 used in accordance with some embodiments of the present invention. As shown in both FIGS. 2B-2C, the forend 210 can include an upper portion 221, a lower portion 222, and a middle beam 223. The middle beam 223 can be disposed generally between the upper portion 221 and the lower portion 222. A series of truss structures can be spaced apart along the lower portion 222 and provide strength for supporting the forend 210.

The forend 210 configuration illustrated in FIG. 2B is designed to be lightweight yet capable of providing structural integrity and enabling a support structure to provide a free-floating barrel configuration. As illustrated, the upper portion 221 comprises a series of circular shaped rings 224A, 224B, 224C, 224D that define a linear gap 225. The linear gap 225 can stretch the length of the forend 210. In currently preferred embodiments, the linear gap 225 is sized to envelop a barrel (like barrel 220B) disposed in the linear gap 225 yet not directly contact the barrel. No direct physical contact enables the barrel to be free-floating in the linear gap thereby providing a mechanical free connection between a barrel of a weapons platform and the forend 210. The series of circular shaped rings 224A, 224B, 224C, 224D may be shaped in other geometric forms (e.g., elliptical, ovoid, rectangular, square, triangular, etc.) capable of yielding the linear gap 225. In addition, the series of circular shaped rings 224A, 224B, 224C, 224D can be tied together with tying mounts 226A, 226B. As shown, the tying mounts 226A, 226B can securedly attached to the circular shaped rings 224A, 224B, 224C, 224D. The circular shaped rings 224A, 224B, 224C, 224D, as illustrated, can also be configured for attachment to the middle beam 223. Still yet, the circular shaped rings 224A, 224B, 224C, 224D can comprise apertures formed in their exterior surfaces for carrying attachment rail surfaces (e.g., Picatinny rails).

The middle beam 223 enables the upper portion 221 to interface with the lower portion 223 of the forend 210 and enables the lower portion 223 to be provided as a truss-weight support system 226. The truss-weight support system 226 is generally disposed between the middle beam 223 and a bottom portion 227 of the forend 210. The bottom portion 227 forms an exterior bottom surface of the forend 210 and may comprise one or more exterior handling surfaces enabling users to hold the forend 210. The truss-weight support system 226 design advantageously provides a rigid cantilever at limited weight that provides a stable platform for the optical mounting rail while maintaining a free-floating barrel for accuracy.

Webs and spans are arranged to provide support for stress points in the truss-weight support system 226. For example, and as shown, in FIG. 2B, the truss-weight support system 226 can comprise one or more spaced apart truss sections. The spacing apart of the truss sections can define gaps between the truss sections. As shown, the truss sections can be positioned in various manners between the middle beam 223 and the bottom portion 227. For example, truss members 228A, 228B are positioned generally orthogonal to the middle beam 223 and the bottom portion 227. In another example, truss member 229 can comprise multiple portions 229A, 229B (e.g., in a general V-shape). The multiple portions 229A, 229B can be disposed at an angle to the bottom portion 227 and converge together proximate the middle beam 223.

The truss-weight support system 226 can also comprise other features. For example, the truss-weight support system 226 can comprise one or more swivel attachment points. One such swivel attachment point can be a dual flush cup sling swivel attachment point 231. The dual flush cup sling swivel attachment point 231 can be located proximate a forward end of the forend 210. This forward end can be positioned proximate a bipod spigot 232. The bipod spigot 232 can support use of various bipod styles (e.g., AMSD, Parker Hale and Versapod).

Other features of the truss-weight support system 226 include section partition members 233, 234. The section partition members 223, 234 can be disposed to partition the lower portion 223 in multiple sections and to support the middle beam 223. In some embodiments, the multiple sections may have varying widths such that tapering of the lower portion 223 is achieved.

The forend portion 210 can also be configured to enable various heat management features. For example, as shown in FIGS. 2B-2C, the forend portion 210 can be openly exposed such that the truss-weight support system 226 is open to the surrounding environment, such as ambient air. Such openness enables a cooling system by enabling a barrel placed in the linear gap 225 to dissipate heat. Indeed, such an embodiment may be designated as a free floating forend that is designed to be lightweight yet maximize ambient airflow around a free floating barrel. An open free floating configuration can also enable reduced mirage associated with heat leaving the barrel surface.

In addition, and according to some embodiments, the forend portion 210 can comprise one or more heat shields. For example, and as mentioned above, the tying mounts 226A, 226B can be configured as heat/mirage shields 226A, 226B. The heat/mirage shields 226A, 226B, as shown, can be disposed along the forend 210 on either side of the forend 210. The heat/mirage shields 226A, 226B can be disposed such that they prevent heat dissipation from a barrel situated below the shields 226A, 226B from passing proximate devices mounted onto a rail attachment surface disposed on the forend 210. As a result, the heat/mirage shields 226A, 226B can prevent barrel heat from dissipating upward into a line of sight of utilized optics. Heat dissipated from a barrel can create a mirage and obstruct view through the scope or adversely affect lasers and sensors. Thus, heat/mirage shields 226A, 226B can be provided to shield line of sights from deteriorating. It should be understood that more heat/mirage shields can be utilized and that position of the heat/mirage shields can vary in accordance with various embodiments of the present invention. For example, and as discussed below, heat/mirage shields can be configured to envelop the upper portion 221 and the lower portion 222 of the forend. In addition, multiple heat/mirage shields can be mounted on the rings 224A, 224B, 224C, 224D so that the linear gap 225 is shielded in full by multiple heat/mirage shields.

FIG. 2C also shows various additional features of embodiments of the present invention. As shown, FIG. 2C illustrates an exploded exemplary embodiment of a forend 210. The forend 210 can comprise a picatinny rail free floating forend and a forend body 235. A picatinny accessory rail bridge 236 is can be coupled to the forend body 235. The picatinny accessory rail bridge 236 can partially define the linear gap 225 that is discussed above. The linear gap 225 can be a hollow precision cylindrical channel through which various barrels can be spanned.

The forend 210 can also have other features in other embodiments. For example, the forend 210 may comprise a top Picatinny rail designated at the 0 degree position, a right side Picatinny rail designated at the 90 degree position, and a left side Picatinny rail at the 270 degree position. Right and left side angled Picatinny rails 237 may also be located at the 135 degree and 225 degree positions. In yet another embodiment, a Picatinny rail 238 can be attached to the bottom of the forend 210 at the 180 degree location.

The Picatinny accessory rail bridge 236 preferably comprises a plurality of mounting points to which one or more Picatinny rails can be attached. A top Picatinny rail can be attached on the top of the Picatinny accessory rail bridge 236, also designated as the 0 degree position. The top Picatinny rail can be preferably approximately 305 millimeters/12 inches in length. Side Picatinny rails can be each approximately 109 millimeters/4.3 inches in length. The Picatinny rails can serve as dedicated mounting points for optical equipment. In other contemplated embodiments, more or fewer rail attachment members may be employed in a plurality of different positions according to operational requirements. Thus, it should be understood that more, fewer, or differently configured attachment devices can be used in accordance with the various embodiments of the present invention.

In some currently preferred embodiments, a top Picatinny rail can be a unitized monolithic Picatinny rail that locks the forend to a barreled action and lower receiver. Side Picatinny rails can be attached to the Picatinny accessory rail bridge 236 parallel to the top Picatinny rail at 320/90 degree and 330/270 degree. The top Picatinny rail can be approximately 490 millimeters/19.3 inches in length. Other suitable lengths have been contemplated for both the top and side Picatinny rails and may be employed in various embodiments. In a further contemplated embodiment, an integrated Picatinny rail section 238 is disposed at the 180 degree position along the bottom front of the forend 210. This Picatinny Rail section 238 provides a connection point for bipods, sensors, lasers, pointers, range finders and illuminators.

In other contemplated embodiments, the forend 210 may comprise a Squared Target, Tapered, Power Cell, and Power Cell Electro-Optic forend design features. The Squared Target Forend (STF) is also a modular forend embodiment that is comprised of a wide flat bottom popular in the competition and target shooting communities. The STF employs an integrated bridge rail system allowing for the attachment of various types of bipod field stabilization devices and electro-optic devices. The STF can be manufactured from precision machined lightweight high strength alloys, plastics composites, and advanced polymers. A squared configuration preferably comprises a textured tactile surface to enable the shooter to ergonomically grip the forend of the weapons platform 200.

The Tapered Forend (TF) is another modular design embodiment that features a tapered bottom popular in the tactical competition, target shooting, and hunting communities. The TF also employs an integrated bridge rail system allowing for the attachment of various types of bipod field stabilization devices and electro-optic devices. The TF can be manufactured from precision machined lightweight, high-strength alloys, plastics, composites, and advanced polymers.

The Power Cell Forend (PCF) is another modular embodiment that features an integrated power cell (battery) and charging circuitry housed in a waterproof compartment. The PCF provides power for visible lights, infrared pointers, and illuminators, lasers, range finders, night vision and thermal devices attached to the rifle. The PCF can utilize commercially off the shelf batteries (e.g. AA, 123, etc.), military batteries, or rechargeable batteries. The PCF can also comprise a connector enabling a power cell to be recharged with 9-32 vdc, 120 vac or 220 vac power sources. The PCF can also use an integrated bridge rail system allowing for the attachment of various types of bipod field stabilization devices and electro-optic devices. The PCF can be manufactured from precision machined lightweight, high-strength alloys, composites plastics, and advanced polymers.

The Power Cell Electro-Optic Forend (PCEOF) is an advanced modular design that features an integrated power cell (battery) and changeable multi-function electro-optic modules. The onboard power cell and electro-optics (EO) module can be housed in waterproof shock resistant mounts within the forend. The integrated EO module is specifically designed to be inserted into a forend receptacle cavity and interface in the forend. The PCEOF can incorporate a multi-function sensor or EO module comprised of different combinations of visible lights, infrared pointers and illuminators, lasers, range finders, night vision, thermal and GPS devices. The PCEOF utilizes either commercially off-the-shelf batteries (i.e. AA, 123, etc.), military batteries, or rechargeable batteries. The PCEOF incorporates a connector that allows the power cell to be recharged with 9-32 vdc, 120 vac or 220 vac power sources, or powered off-board from other power sources (e.g. vehicles, radio batteries, solar cells, etc.). The PCEOF can include an integrated bridge rail system allowing for the attachment of various types of bipod field stabilization devices and electro-optic devices. The PCEOF can be manufactured from precision machined lightweight, high-strength alloys, plastics composites, and advanced polymers.

In other contemplated embodiments, the forend 210 preferably accommodates detachable accessories. These may include night vision and thermal imaging devices, visible/IR laser pointers, illuminators, lasers, range finders, white lights, sensors, and other electronic components. Such accessories can be attached to a Picatinny Rail or other such attachment point. In other contemplated embodiments, the forend 210 includes an environmentally protected electro-optic/sensor module compartment for housing electronic components such as a laser range finder, GPS, DMC (Digital Magnetic Compass), anti-cant, visible laser pointer, infrared laser pointer, environmental sensors, and other electronic components.

In further contemplated embodiments, the forend 210 preferably includes sling attachments. For example, the forend 210 can include two sling attachment points at concentric points along the modular forend assembly 235, one on the lower receiver 220 and two on the butt stock 230. The attachment points can be recessed flush mounted sling swivel cups to enable the use of a variety of detachable rifle slings and user preferences.

Thermal Heat Mirage Management System & Other Modular Forend Features

Figure 2D:
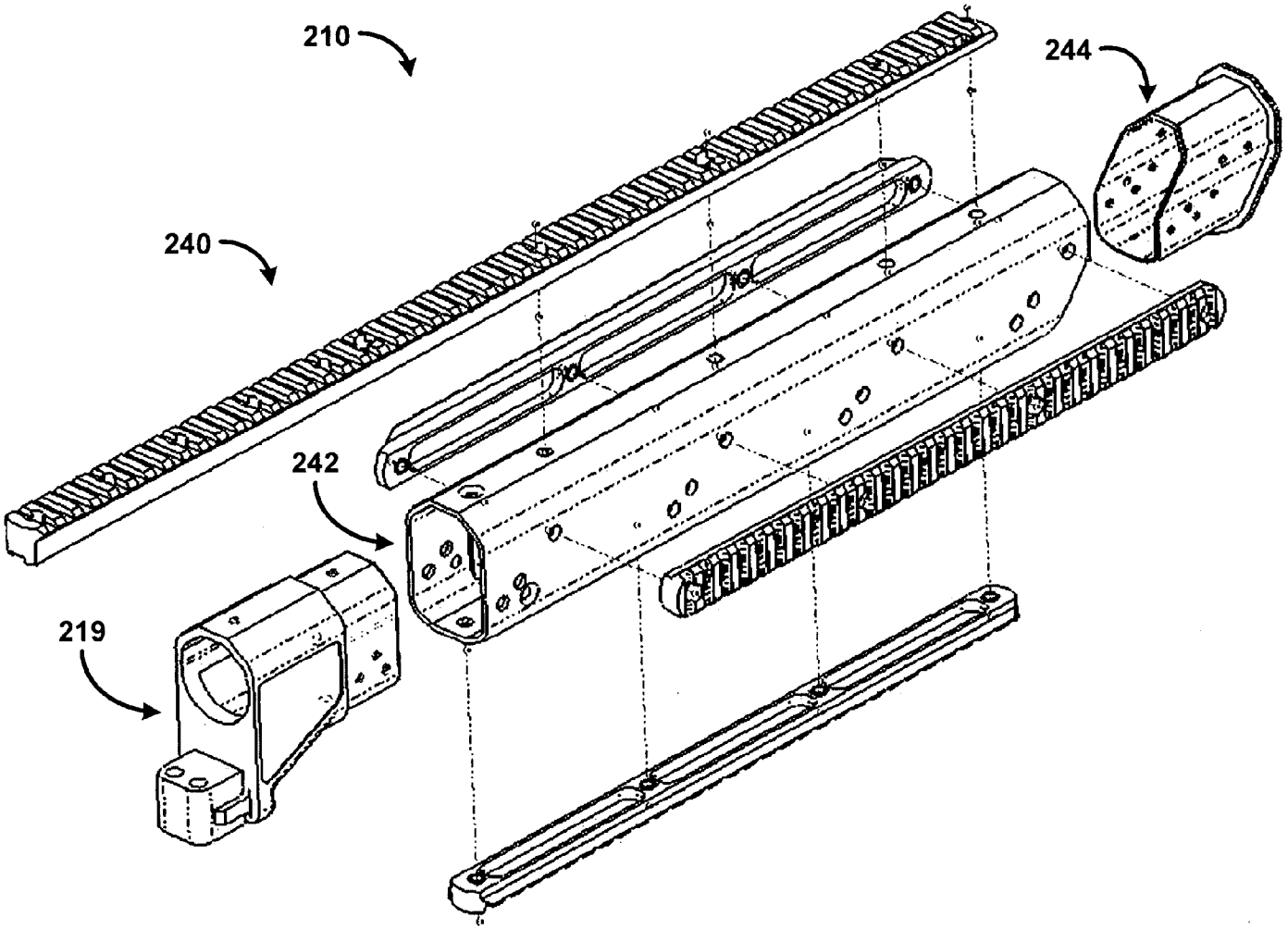
FIG. 2D illustrates an exploded view of an enclosed forend showing various forend features in accordance with some embodiments of the present invention.
Figure 2E:
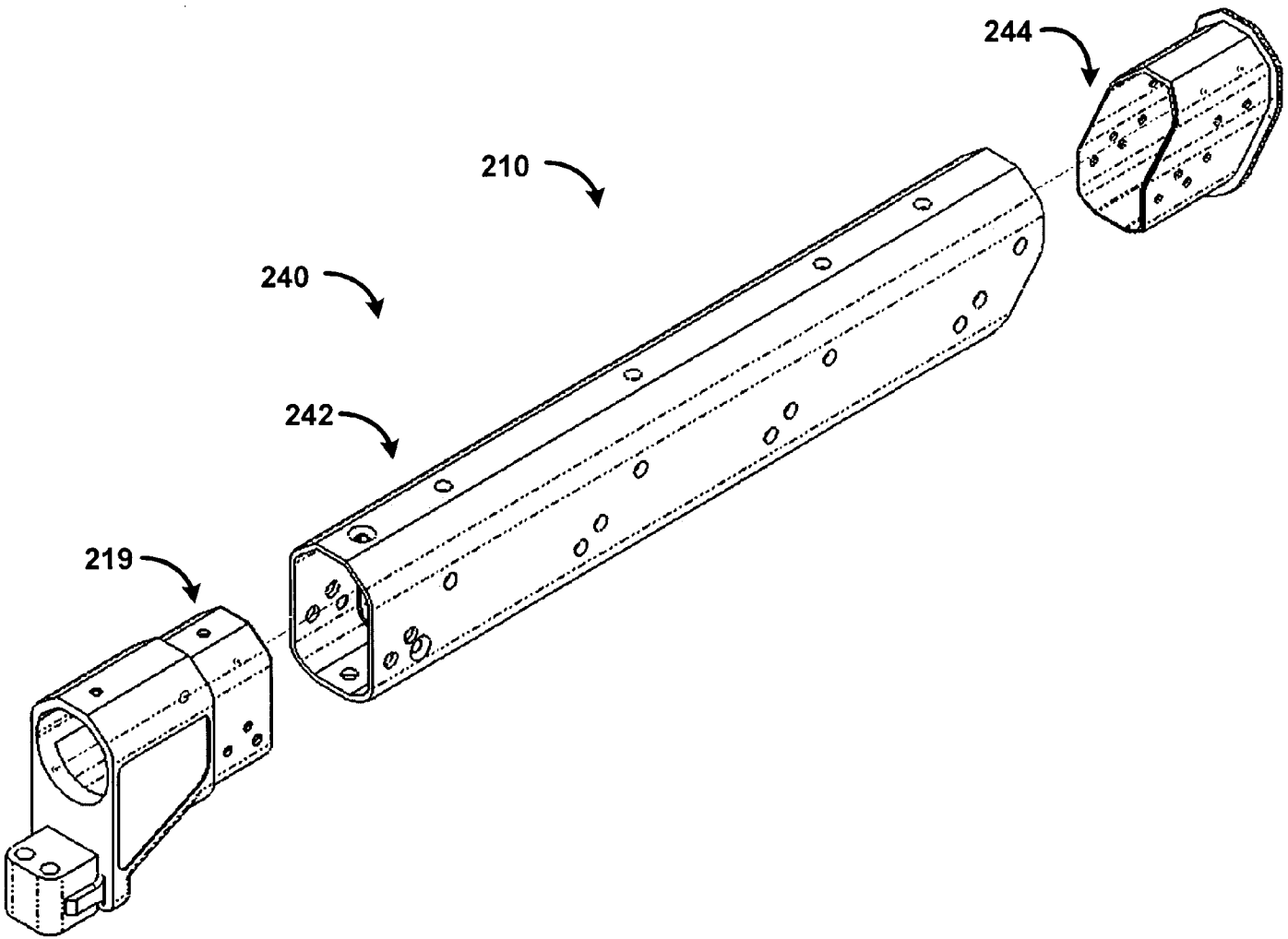
FIG. 2E illustrates various modular sub-components of a forend in accordance with some embodiments of the present invention.
Figure 2F:
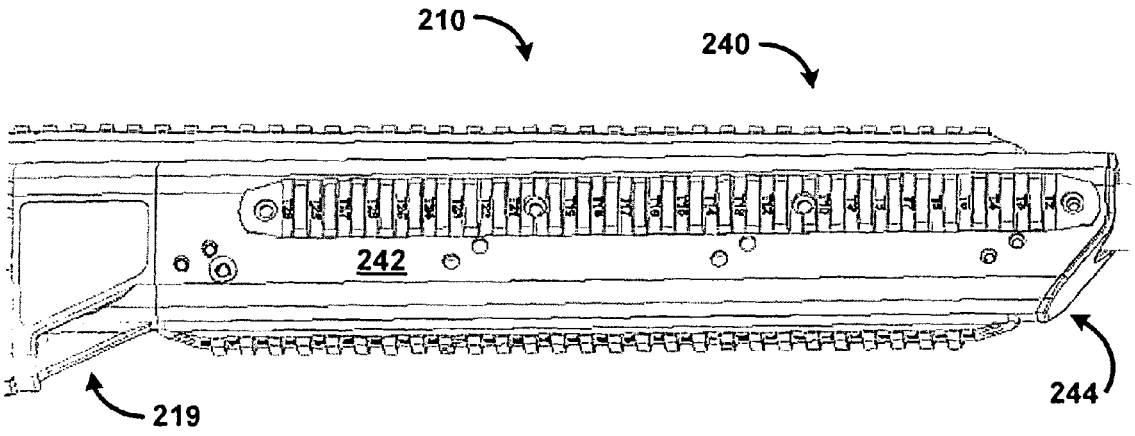
FIG. 2F illustrates a close-up, perspective view of an enclosed forend used in accordance with some embodiments of the present invention.
Figure 2G:
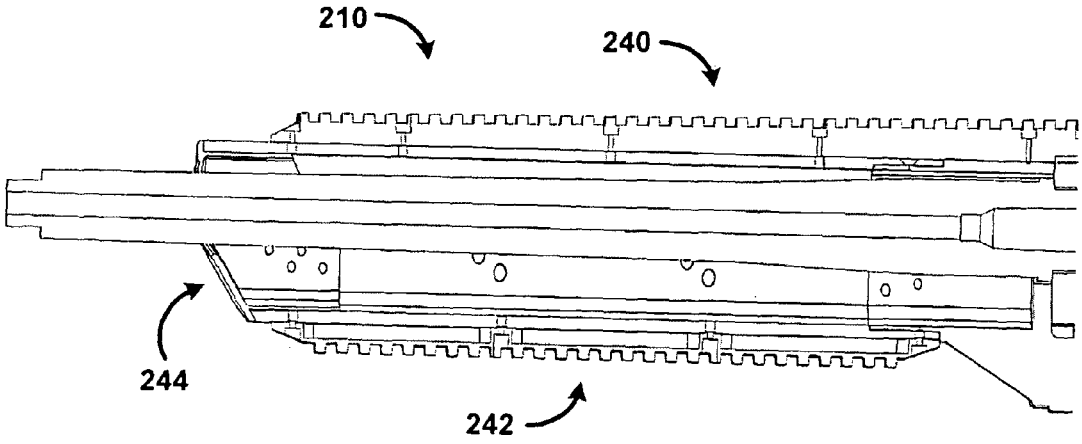
FIG. 2G illustrates a cross-sectional view of an enclosed forend used in accordance with some embodiments of the present invention.
Figure 2H:
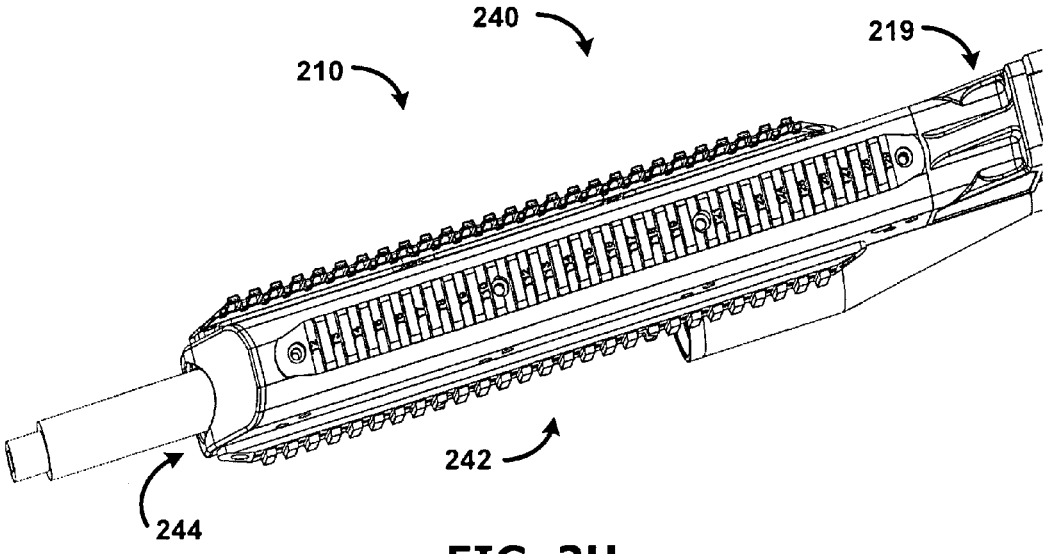
FIG. 2H illustrates a close-up, underside view of an enclosed forend used in accordance with some embodiments of the present invention.
Figure 2I:
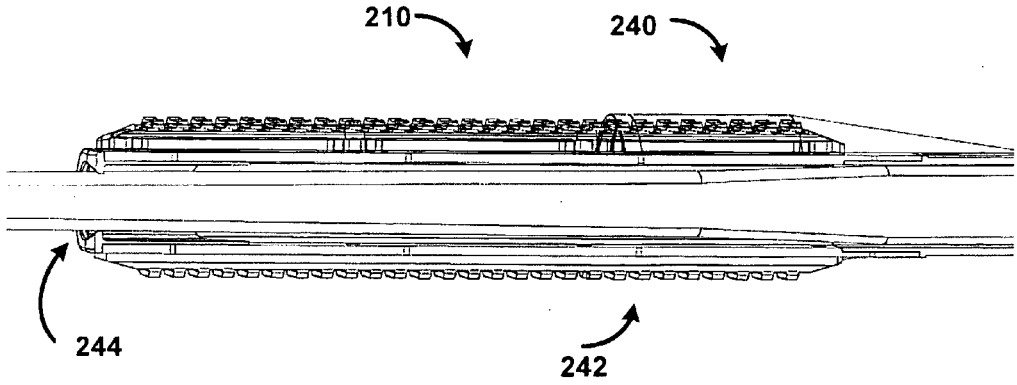
FIG. 2I illustrates another cross-sectional view of an enclosed forend used in accordance with some embodiments of the present invention.

Other advantageous features of some embodiments of the present invention relate to a forend comprising a thermal heat mirage management system and other modular components. FIGS. 2D through FIG. 2I illustrate various features of a forend in accordance with the various embodiments of the present invention. FIG. 2D illustrates an exploded view of an enclosed forend showing various forend features in accordance with some embodiments of the present invention. FIG. 2E similarly illustrates various modular sub-components of a forend in accordance with some embodiments of the present invention. FIG. 2F illustrates a close-up, perspective view of an enclosed forend used in accordance with some embodiments of the present invention, and FIG. 2G illustrates a cross-sectional view of an enclosed forend used in accordance with some embodiments of the present invention. FIG. 2H illustrates a close-up, underside view of an enclosed forend used in accordance with some embodiments of the present invention. FIG. 2I illustrates another cross-sectional view of an enclosed forend used in accordance with some embodiments of the present invention. The various forends illustrated in FIGS. 2D-2I may be used as forends for the weapons platform 200.

In some embodiments, such as those illustrated in FIGS. 2D-2I, the weapons platform 200 can comprise a thermal heat mirage management system 240. The system 240 can include various internal and external components to remove heat from undesired areas. For example, the system 240 can be configured to wick heat from away the barrel in a controlled fashion. This advantageously enables reduction of mirage effects, whether in an inverted trough version, or a tubular version with an enclosed fore-end cap. The system 240 can include a chassis tube portion 242 and a forend cap portion 244. In some embodiments, the system 240 may also include the connection portion 219 and/or the receiver portion 220.

The various components of the system 240 are preferably configured to absorb, remove, and/or isolate heat such that dissipated heat does not interfere with accessory devices mounted on the weapons platform. For example, the forend tube portion 244 is preferably configured to envelop a barrel such that heat emitted in the linear gap 225 due to firing of the weapons platform 200 remains substantially disposed in the forend tube portion 242. By virtue of heat being contained within the tube portion 242, the heat can be absorbed and wicked toward other components of the weapons platform 200. As a result, in some embodiments, the connection portion 219 may be a first heat sink and the receiver portion 220 may be a second heat sink. Provision of a double heat sink feature with varying heat conducting materials enables movement of heat away from a barrel of the weapons platform in an advantageous manner.

As best shown in FIGS. 2D and 2E, the forend 210 can be configured as a heat containing tube. The forend tube portion 242 can be shaped at its ends to receive corresponding end portions of the connector 219 and forend cap 244. As illustrated, ends of the connector 219 and forend cap 244 can be sized and shaped for insertion into the forend tube portion 242. Such a feature enables a tight fit in providing a rigid yet lightweight forend 210. In accordance with some embodiments, fasteners can be used to mechanically couple the connector 219 and the forend cap 244 to the forend tube portion 242. When joined together, the connector 219, the forend cap 244, and the forend tube portion 242 define an interior space, such as linear gap 225. A barrel can be inserted through the interior space such that it floats within the tube. In other words, the forend tube portion 242 can envelop a barrel—yet not mechanically touch the barrel. This advantageous feature of some embodiments of the present invention ensures that barrel accuracy performance is not hindered by objects contacting the barrel.

The various components of the thermal heat mirage management system 240 can be implemented with various materials. For example, the connector 219, the forend cap 244, and the forend tube portion 242 can be formed of a lightweight yet sturdy material. One or more of these components can be formed with lightweight material that has non-heat conductive properties. For example, in currently preferred embodiments, the connector 219, the forend cap 244, and the forend tube portion 242 can be fabricated from carbon-based composites. Currently preferred embodiments include pre-peg carbon fiber. Other lightweight materials such as various aluminum alloys may also be used in some embodiments.

Other advantageous features of some embodiments of the present invention relate to a forend 210 comprising various advantageous forend 210 features. As discussed above, the forend 210 can comprise a tube 242 that can be provided with a cap 244. The tube 242 can be sized and shaped in many ways as desired by a user. In addition, the tube 242 can be configured to hold and/or carry a number of attachment surfaces. Attachment surfaces (e.g., Picatinny rails) can be used for carrying or mounting accessory devices for use with a weapons platform. In addition, the tube 242 can define an interior space through which a weapons platform barrel can be enabled to free float. The cap 244 can be used to seal the tube 242 in accordance with some embodiments.

By sealing the tube 242, and in accordance with some embodiments, the cap 244 can provide a compartment or a mounting assembly. For example, the cap may include a compartment or mounting facility for a various accessories such as GPS, shot counters, beacons, spare parts, laser, etc. In other embodiments, the cap 244 and/or the tube 242 may also be used as a storage compartment or a mounting surface for a power source (e.g., batteries, solar panels, etc.). In still yet other embodiments, the cap 244 and/or the tube 242 may also be used as a storage compartment or a mounting surface for various electro-optic modules.

The tube can have various exterior characteristics. For example, in some embodiments, the tube 242 can be a non-cylindrical shape. For example, the tube may be shaped so that it has a generally square or rectangular shape. Such shapes can enable exterior surfaces having improved ergonomic abilities and enabling ease of attaching various mounting surfaces (e.g., attachment rails) and quick disconnects for slings.

As best shown in FIGS. 2D and 2E, the forend 200 can comprise a connector 219 (or a mating block). This feature can serve as a modular interface between the forend 210 tube portion 242 and a receiver. The use of the mating block 219 at a fore-end rear frame to the mid-section of the stock provides a repeatable return-to-zero mounting, with substantial structural strength, and effective heat transfer. While a mating block is currently preferred, some embodiments of the present invention need not be equipped with such a feature. In this manner, an integral tube portion 242 can be directly connected to a receiver with no interface features.

Receiver Assembly

Figure 3A:
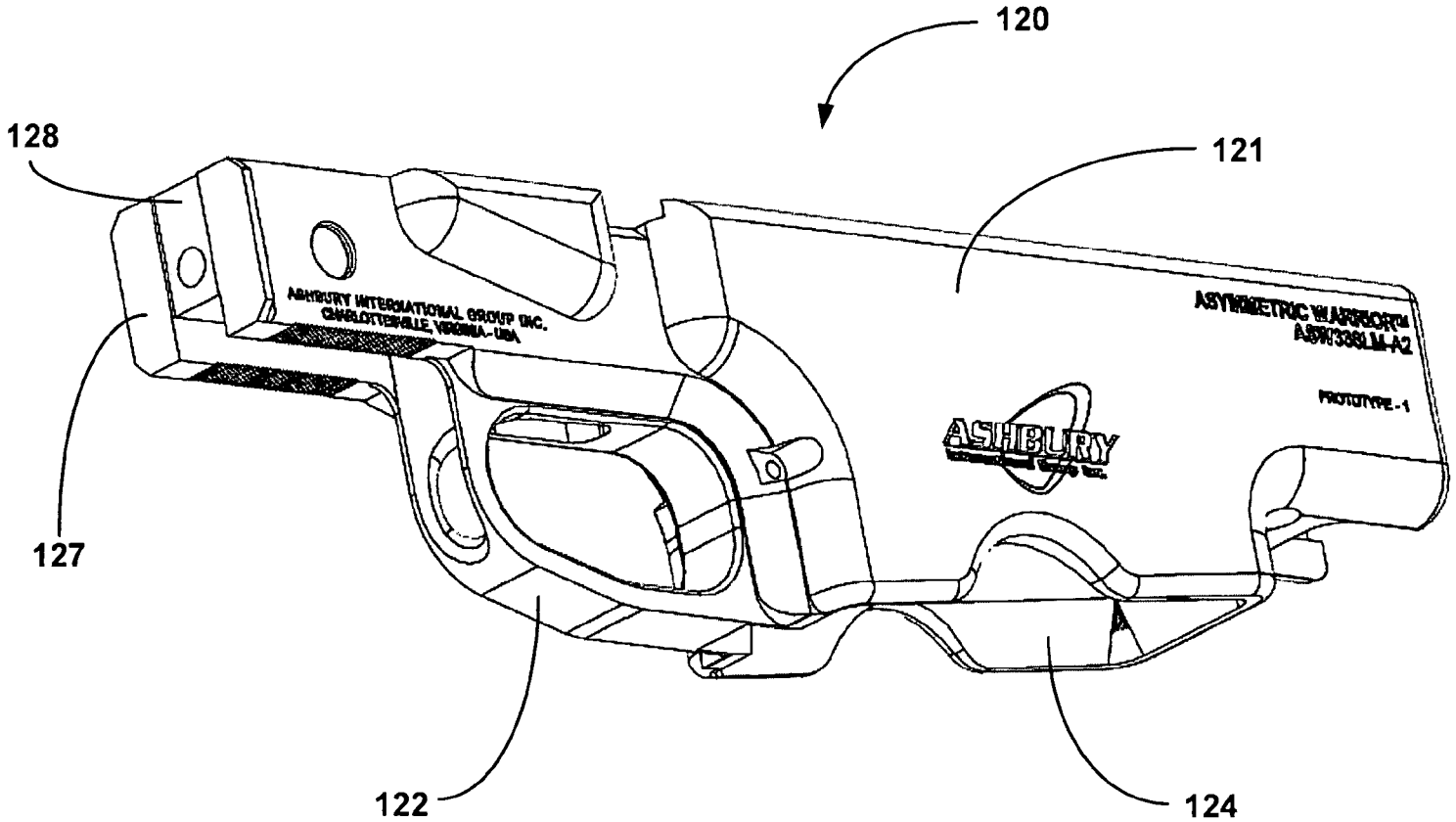
FIG. 3A illustrates a perspective view of a receiver used in accordance with some embodiments of the present invention.

FIG. 3A illustrates a lower rear perspective view of an exemplary embodiment of the receiver assembly 120. The receiver assembly 120 can comprise a housing 121. The housing 121 is preferably cast as a single component from one of the alloys described above. Embodiments of the receiver assembly 120 are preferably configured to accommodate a variety of (left hand/right hand) barreled action configurations including: Surgeon Short Action Repeater; Remington 700 Short Action; TRG-22, Surgeon XL Repeater; and Remington 700 Long Action, Remington 700 Long Action Magnum, SAKO TRG-42, and others. An embodiment of the receiver assembly 120 may be capable of accommodating several different barreled action configurations or may be specifically designed to accommodate only one particular barreled action. The receiver assembly 120 of the tactical rifle stock assembly 100 can be selected to accommodate a barreled action configuration desired by the user. The receiver assembly 120 can be interchanged and coupled to the forend assembly 110 and butt stock assembly 130 as described above with reference to FIGS. 1A and 1B.

The receiver assembly 120 can further comprise a trigger guard 122. The trigger guard 122 is preferably an integrated component of the receiver assembly 120. The geometry of the trigger guard 122 may be dimensioned to accommodate a shooter's bare hand, use of Mission Oriented Protective Posture ("MOPP"), and cold weather gloves when operating the trigger in hot and cold weather. The receiver assembly 120 can comprises a magazine well 401 adapted to receive a five round and/or ten round magazine.

Figure 3B:
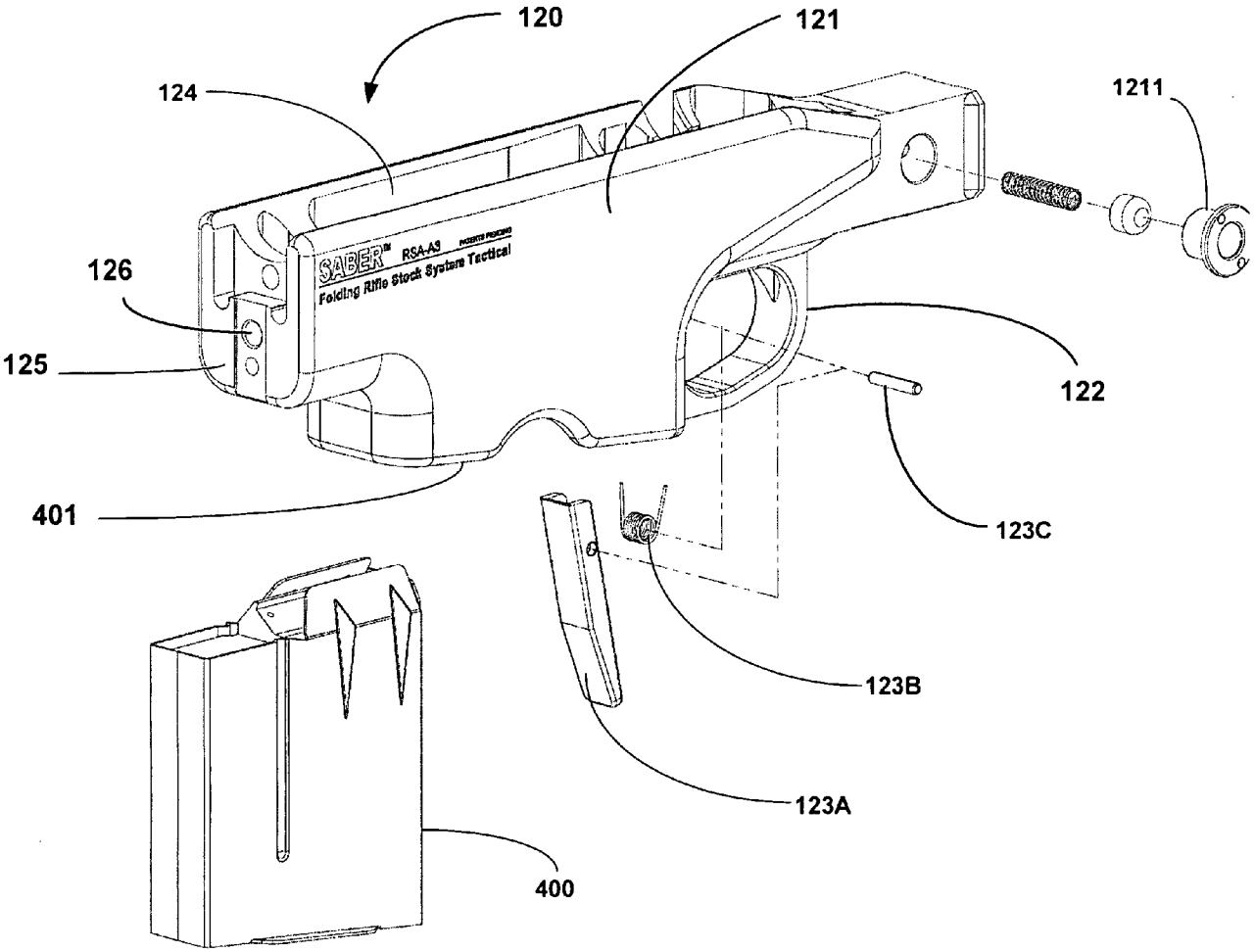
FIG. 3B illustrates an upper frontal perspective view of a receiver assembly in accordance with some embodiments of the present invention.

FIG. 3B illustrates an upper frontal view of an exemplary embodiment of the receiver assembly 120. The lower receiver assembly 120 preferably employs a double flush cup sling swivel 1211 attachment point on the rear of the housing 121. The receiver assembly 120 can comprise an action bay 124 adapted to accommodate and interface with various barreled actions. The action bay 124 preferably utilizes a precision beddingless interface, eliminating the need for an epoxy like compound to mate the receiver assembly 120 to a barreled action. Bedding compounds are necessary to mate an action to a conventional stock because the receiver of a conventional stock is not a precision machined part. The action bay 124 is precision machined to specific tolerances to enable an exact fit to a barreled action without the need for bedding compounds. The action bay 124 preferably enables a direct drop-in bolt down installation capability between the receiver assembly 120 and the barreled action for commercial and custom barreled rifle actions. Users can employ a typical hex or Torx wrench to tighten two or more action retaining bolts to secure the barreled action to the receiver assembly 120.

As mentioned herein, components of the receiver assembly can be precision machined to enable a tight fit between components. For example, the barreled action and the lower receiver 120 of the tactical rifle stock assembly 100 can be precision mated such that they do not move relative to each other. It is believed that the barreled action and receiver 120 move in unison when in operation, transferring the force through the tactical rifle stock assembly 100 thereby reducing impact and recoil.

The receiver assembly 120 can comprise a magazine release lever 123A. The magazine release lever 123A can secure and release a box magazine 400 into the magazine well 401 of the receiver assembly 120. The magazine release lever 123A preferably locks and unlocks to facilitate detachment of the box magazine 400 from the magazine well 401 of the receiver assembly 120. The release lever 123A preferably eliminates or greatly reduces the occurrence of a detachable box magazine inadvertently dropping out of the rifle when in use.

The magazine release lever 123A is preferably protected against impact, and positioned for ease of use by the shooter with either hand. The magazine release lever 123A can be spring loaded by a magazine lever spring 123B. The magazine release lever 123A and the magazine lever spring 123B can be pivotally coupled to the receiver assembly 120 using a lever pin 123C. The magazine release lever 123A enables the shooter to release and replace a magazine without disturbing the position of the tactical rifle stock assembly 100. The magazine release lever 123A can be located in front of the trigger guard 122. This may allow the shooter to reload tactical rifle stock assembly 100 with one hand. In other contemplated embodiments, a M16 style button magazine release can be used in place of the magazine release lever 123A on the side of the magazine well 401. In other contemplated embodiments, the lever 123A may be recessed to prevent the accidental release of the magazine.

The receiver assembly 120 and magazine well 401 can be configured such that the box magazine 400 does not extend below the level of the pistol or hand grip (not pictured) to ensure that the magazine 400 does not compromise the usability of the tactical rifle stock assembly 100. The receiver assembly 120 is preferably adapted to accommodate a wide range of rugged military specification detachable box magazines, including belted magnums (i.e. 7 mm Magnum and 300 Winchester Magnum) and .338 Lapua Magnum/8.6×70 mm.

Figure 4A:
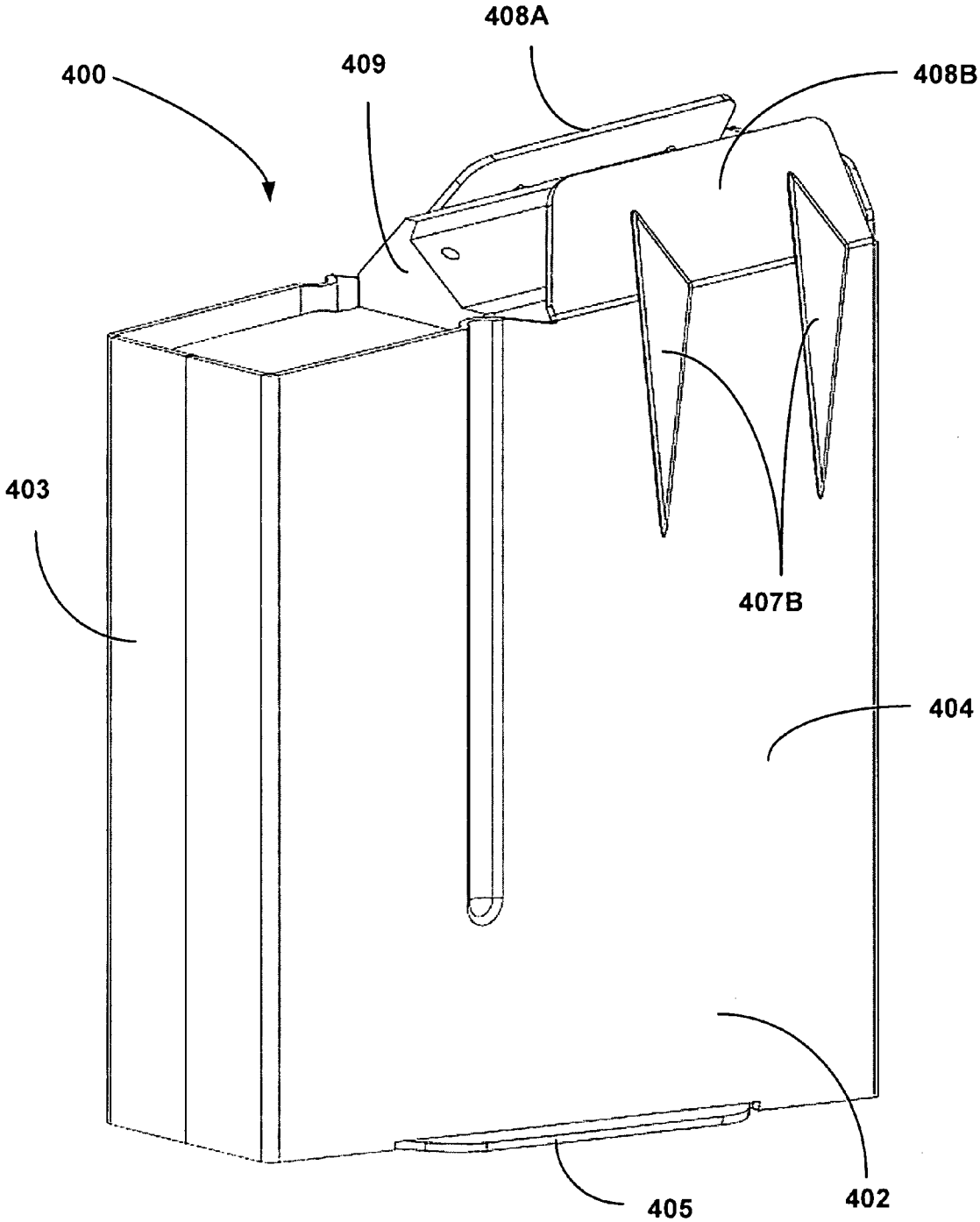
FIG. 4A illustrates another perspective view of the magazine used in accordance with some embodiments of the present invention.
Figure 4B:
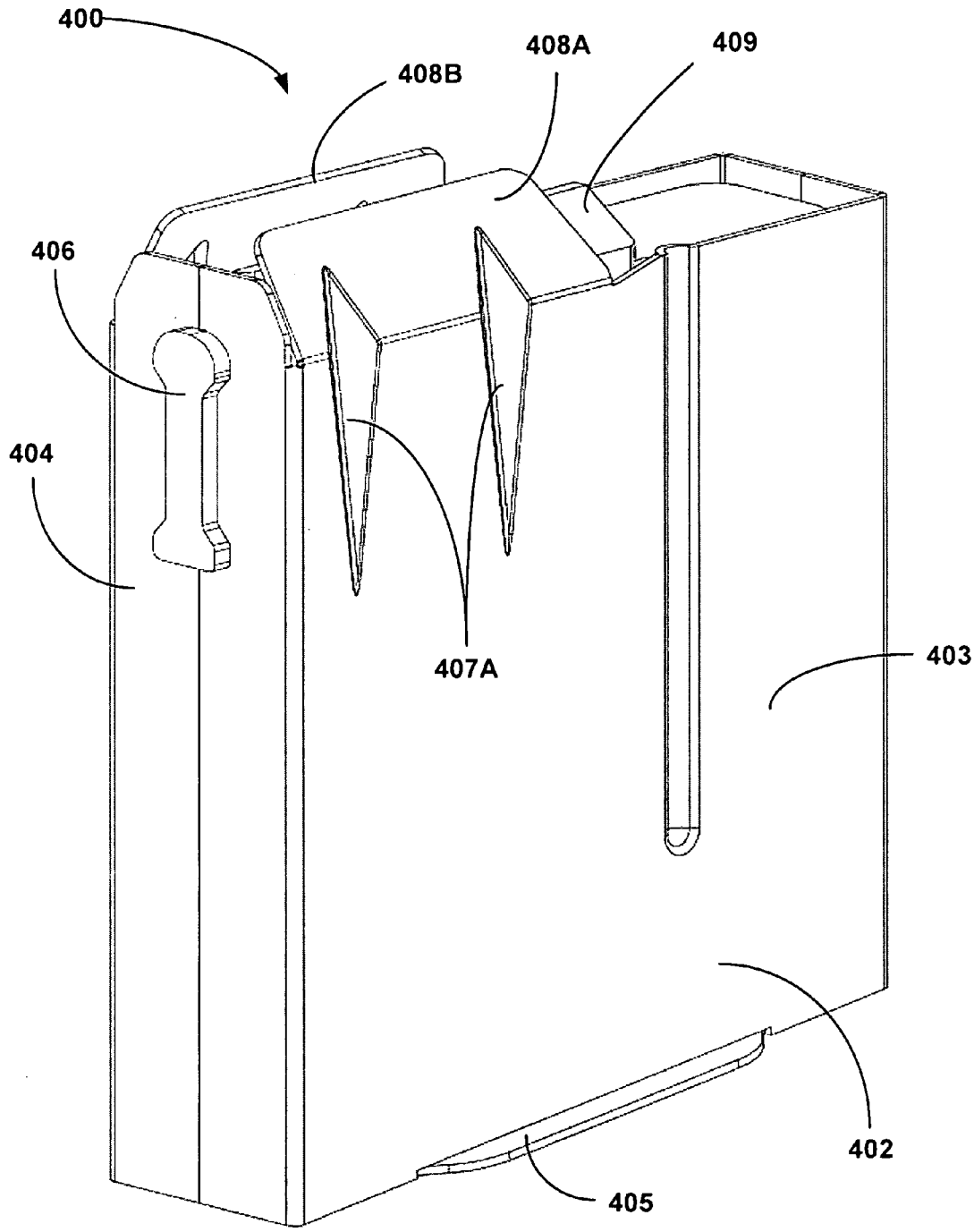
FIG. 4B illustrates yet another perspective view of the magazine used in accordance with some embodiments of the present invention.

FIG. 4A illustrates a front perspective view of an exemplary embodiment of a ten round detachable box magazine 400. The magazine 400 can be inserted into the magazine well 401 of the receiver assembly 120 described above with regard to FIG. 3B. A traditional bolt action rifle employs a five round box magazine. The embodiments of magazine 400 are designed and adapted to house and feed ten rounds into a bolt action rifle, in particular to a barreled action coupled to the tactical rifle stock assembly 100. One of the clear advantages of a ten round magazine is that the user can shoot twice the number of rounds before reloading than with a five round magazine. When shooting long range, reloading can disrupt the position of the rifle, causing the user to lose sight of the target. FIG. 4B illustrates a back perspective view of an exemplary embodiment of a ten round detachable box magazine 400.

Figure 4C:
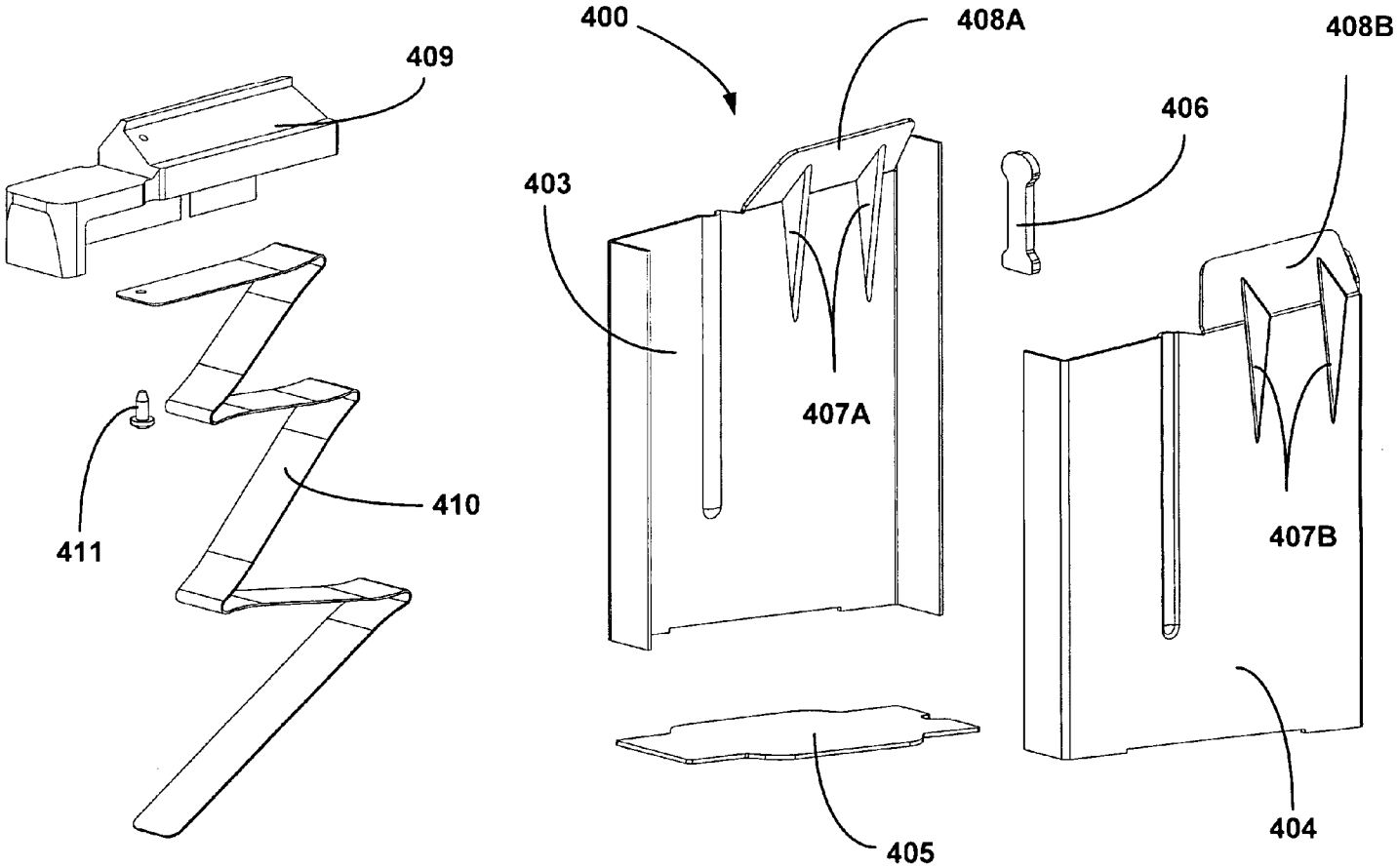
FIG. 4C illustrates an exploded view of the magazine used in accordance with some embodiments of the present invention.

FIG. 4C illustrates a disassembled view of an exemplary embodiment of a ten round detachable box magazine 400.

The box magazine 400 can comprise a body 402. The body 402 can be constructed from stainless steel and can be coated with Tenifer® for corrosion resistance and surface hardening. In other contemplated embodiments, the body 402 can be constructed from any of the metals, alloys, or materials described above. Other materials include ceramic, ceramic-based, and material coated with via physical vapor deposition process.

The body 402 can have a first side 403 and a second side 404. The first side 403 and the second side 404 are preferably substantially identical minor images of each other. The first side 403 and the second side 404 can be precision stamped and TIG welded to the magazine base plate 405. A magazine locking lug 406 can be positioned and TIG welded to the back side of the body 402 of the magazine 400 to secure the upper portions of the first side 403 and second side 404 together. The first side 403 and the second side 404, when joined together, can form a cavity for receiving cartridges. The upper portion of the body 402 can have an opening for loading cartridges into the magazine 400.

The width of the cavity within the body 402 is preferably greater than the width of a cartridge. The cartridges preferably load into the body 402 in an offset double stack orientation. For example, half of the cartridges may abut the first side 403 and half may abut the second side 404 in an alternating manner.

The magazine 400 can comprise a follower 409 preferably having surfaces oriented at approximately 25 and 90 degree complementary angles that stabilize and elevate the cartridge stack toward the top of the magazine. The follower 409 can be urged upward within the magazine by a magazine spring 410. The magazine spring 410 can have a flat non-binding configuration. A fastener 411 can attach the magazine spring 410 to the follower 409. The magazine spring 410 is preferably heat treated to assure that it does not deviate from its spring constant under varying thermal conditions. The heat treated magazine spring 410 preferably provides a uniform level of pressure on the follower 409 such that cartridges are reliability feed into the chamber with a partially full or full magazine 400.

The width of the follower 409 is preferably less than the width of the cavity within the body 402. When a first cartridge is loaded into the magazine 400, it presses against the angled surface of the follower and urges the follower 409 against the first side 403 and the follower 409 urges the first cartridge against the second side 404. The next cartridge that is loaded is preferably in contact with the first cartridge and the first side 403. In this manner, the cartridges can be loaded in an offset double stack configuration.

A first lip 408A can extend from the top portion of the first side 403. The first lip 408A can have an inner incline at 60 degrees toward the inside of the magazine 400. The first lip 408A preferably extends from the back of the first side 403 forward. The first lip 408A preferably does not extend the entire width of the first side 403. The second side 404 can have a substantially identical second lip 408B that is a mirror image of the first lip 408A.

The first side 403 can comprise one or more first de-stacking ramps 407A. The first de-stacking ramps 407A can be precision stamped into the first side 403 at an incline of 15 degrees. The first de-stacking ramps 407 preferably extend into the interior of the cavity of the magazine 400. At least a part of the ramps 407A is disposed on the first lip 408A. The second side 404 can have one or more substantially identical second de-stacking ramps 407B that are a minor image of the first de-stacking ramps 407A. In a preferred embodiment, the first side 403 and the second side 404 each can have two parallel de-stacking ramps 407A and 407B.

The de-stacking ramps 407A and 407B preferably orient the cartridges from a double stack position to a single stack as the cartridges are pushed by the follower 409 toward the 60 degree magazine feed lips 408A and 408B. The magazine feed lips 408A and 408B can hold the top cartridge in place until the bolt from the barreled action pushes the top cartridge into the chamber of the rifle. The magazine follower 409 in conjunction with the de-stacking ramps 407A and 407B preferably enables smooth, uninterrupted jam free feeding of cartridges into the rifle chamber.

Modular, Adjustable Grip Handle

The pistol grip assembly 500 can encompass a number of features including, but not limited to, variable length of pull (i.e., the distance from the back of the grip to the trigger), adjustable grip angle, and interchangeable grip handles. The pistol grip 500 can also be of a modular design. The pistol grip 500, therefore, can be coupleable to many different weapons. In one embodiment, the pistol grip assembly 500 can be coupleable to the receiver of the tactical rifle 100, 200 using a variable length of pull adapter 515 and a single grip fastener 540. Additionally, the pistol grip assembly 500 can be locked at a variety of angles using a plurality of angular adapters 535.

In one embodiment, the pistol grip 500 can be coupleable to the receiver 520 of the tactical rifle 100, 200 using a single grip fastener 540. The grip fastener 540 is preferably an Allen bolt or Torx bolt with standard machine threads. In other contemplated embodiments, the fastener 540 can include a t-handle, knurled knob, or the like, which can allow for toolless pistol grip 505 or grip angle adapter 535 changes. In yet another embodiment, the grip fastener 540 can be retained in the pistol grip 505 to prevent loss.

The pistol grip assembly 500 can comprise a commercial pistol grip 505. The pistol grip 505 can, for example, be similar to the pistol grip employed on an AR-15 or M16 type rifle. In a preferred embodiment, commercial, off-the-shelf ergonomic rubberized, textured non-slip M16 style grips, such as the MAGPOC® M1AD model, can be employed. In other embodiments, other types of production and custom pistol grips are contemplated. In other contemplated embodiments, the pistol grip can include additional rubber inserts to enable proper trigger engagement by shooters with varied hand sizes and to enable the use of gloves, such as flight gloves and cold weather gloves, while shooting.

The pistol grip 505 is preferably interchangeable in accordance with either the tactical requirements or shooter preferences. The pistol grip 505 can be attached to the lower receiver assembly 520 with a single machine screw 540 inserted through an opening 502 in the bottom of the pistol grip 505. In an exemplary embodiment, the shooter can change grip styles using a standard Allen or Torx wrench to unscrew the pistol grip assembly 505 and replace it with a different grip. In other contemplated embodiments, the grip fastener 540 can allow for toolless removal of the pistol grip assembly 500.

Figure 5A:
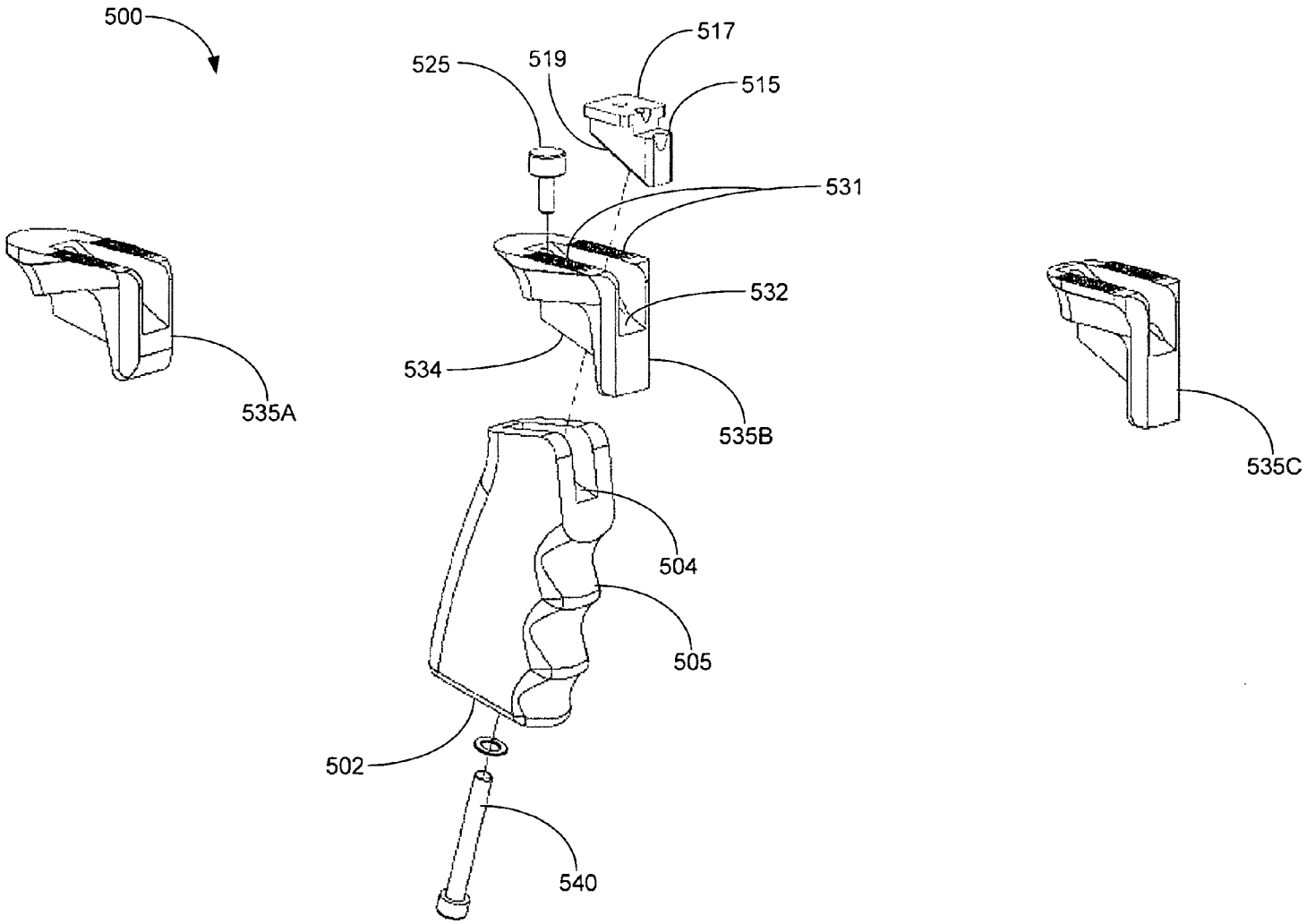
FIG. 5A illustrates an exploded view of a modular, adjustable pistol grip used in accordance with some embodiments of the present invention.

Referring to FIG. 5A, the pistol grip assembly 500 can comprise a pistol grip 505, an angular adapter 535, a length of pull adapter 515, a grip fastener 540, and a grip retainer 525. The grip retainer 525 can pass through the angular adapter 535 and can be threadably connectable to the pistol grip 505. The grip retainer 525 can aid in assembly by reducing the number of loose elements that must be assembled on the tactical rifle 100, 200 at a given time. The pistol grip assembly 500, however, can be assembled and is fully functional with or without the grip retainer 525. This can be advantageous, for example, to reduce manufacturing costs or when the grip retainer 525 is lost in the field. The grip fastener 540 preferably passes through the pistol grip 505, the angular adapter 535, and is threadably connected to the length of pull adapter 515.

Figure 5B:
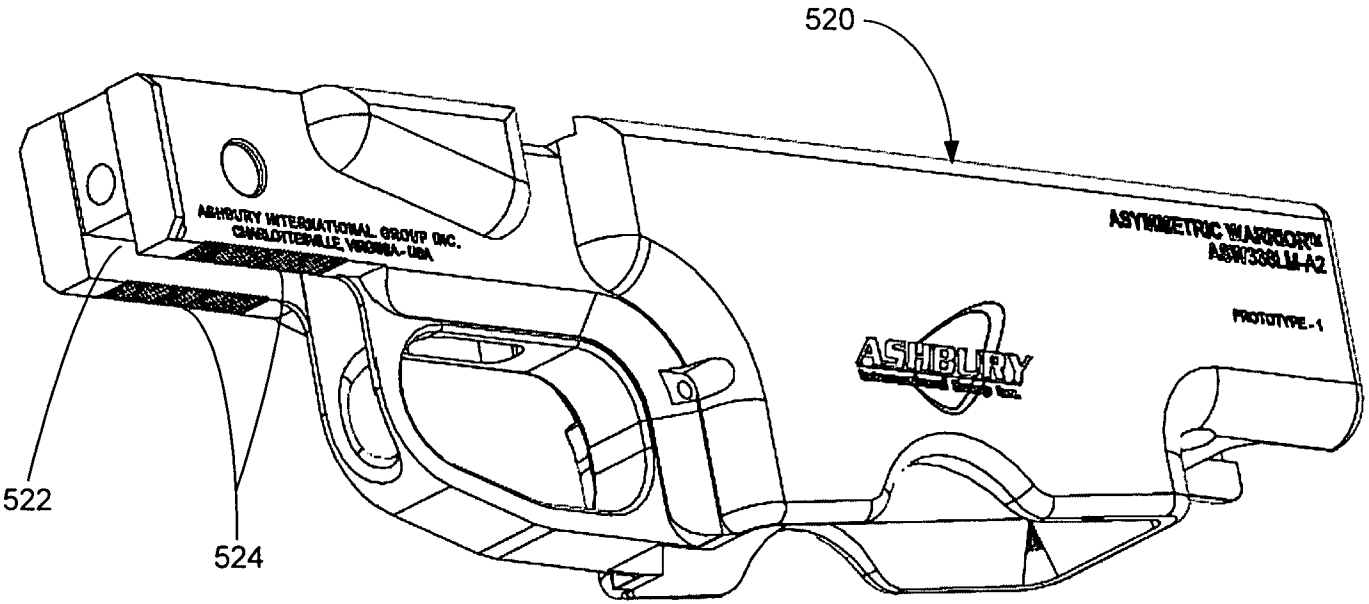
FIG. 5B illustrates another perspective view of the receiver used in accordance with some embodiments of the present invention.

The length of pull adapter 515 can comprise a first end 517 and a second end 519. The first end 517 of the length of pull adapter 515 can be t-shaped and can be in communication with a t-shaped slot 522 in the bottom of the lower receiver 520. See FIG. 5B. In alternative embodiments, other slot configurations are contemplated. The second end 519 of the length of pull adapter 515 can preferably be coupleable with an angled slot 532 in the angular adapter 535. The pistol grip assembly 500 can preferably be adjusted 0.6 inches fore and aft to facilitate correct grip and finger engagement of the trigger on the tactical rifle 100, 200.

The angle of the pistol grip 505 can also be adjustable. The angular adapters 535A, 535B, and 535C can enable the pistol grip 505 to couple with the lower receiver assembly 520 at a variety of included angles. These angles can be selected by the shooter depending on the shooter's position, standing, kneeling, sitting or prone, to maximize comfort, stability, and/or accuracy. The angular adapter 535 can be manufactured to include many angles and other suitable angles have been contemplated.

The top portion of the angular adapter 535 preferably comprises a plurality of serrated surfaces 531. When the pistol grip assembly 500 is installed, these serrated surfaces 531 can be in communication with complementary serrated surfaces 524 on the lower receiver 520. The bottom portion 534 of the angular adapter 535 is, in turn, coupleable with a standard slot 504 in the pistol grip 505. The angular adapter 535 and length of pull adapter 515 are manufactured to close tolerances. They can preferably be manufactured to a tolerance of approximately 0.0005 inches. This enables the pistol grip assembly 500 to be rigid when assembled.

To change the pistol grip 505 or grip angle, the shooter can first loosen the grip fastener 540 completely and remove the grip assembly 500 from the lower receiver 520. The shooter can then choose the pistol grip 505 suitable for his shooting style or mission. The shooter can next choose a suitable grip angle by choosing the corresponding angular adapter 535A, 535B, or 535C. The angular adapter 535 can be affixed to the pistol grip 505 using the grip retainer 525 to simplify reassembly, if desired. The shooter can then insert the grip fastener 540 though the pistol grip 505 and the angular adapter 535. The shooter can then thread the grip fastener 540 into the length of pull adapter 515 and tighten.

When tightened, the tension provided by the grip fastener 540 can secure the pistol grip assembly 500 as a rigid unit. Additionally, the tension provided by the grip fastener 540 can frictionally lock the length of pull adapter 515 in the groove 522 in the lower receiver 520. Finally, the compression created by the grip fastener 540 between the serrated surfaces located on the lower portion 524 of the lower receiver 520 and the upper portion 531 of the angular adapter 535 can further act to frictionally lock the pistol grip assembly 500 in place on the tactical rifle 100, 200.

This can provide a pistol grip assembly 500 that has interchangeable pistol grips 505 and that can be adjusted quickly and easily for both length of pull and grip angle. The preset selectable angles for the angular adapters can be, for example and not a limitation, 11 degrees (515A), 17.5 degrees (515B), and 25 degrees (515C). It is contemplated, however, that the angular adapters can be manufactured to include many different angles. The angular adapter 535 and the length of pull adapter 515 can preferably be manufactured of 7075-T6 aluminum alloy. In additional contemplated embodiments, other lightweight, high-strength alloys, composites, plastics, advanced polymers, and so on, may be used.

Versatile Buttstock Body & Length of Pull Feature

The buttstock assembly ("buttstock") 630 can encompass a number of features including, but not limited to, adjustable length of pull, an adjustable recoil pad, an adjustable comb (i.e., cheek piece), and accessory mounting points. The buttstock 630 is preferably designed to be coupleable to the receiver 120, 220 of the tactical rifle 100, 200 using a folding hinge mounting system ("mounting system") 700, described in detail below. The buttstock 630 also can be lockable in both an extended position and a folded position to provide additional flexibility.

The buttstock 630 and mounting system 700 can be of a modular design. This can allow either component to be mounted on a variety of weapons platforms. In one embodiment, the buttstock 630 can be attached to the tactical rifle 100, 200 via a mounting system 700. Due to the use of highly accurate machining and/or casting processes, the buttstock 630 can be attached to the mounting system 700 using a single fastener. Similarly, the mounting system 700 can be attached to the receiver of the tactical rifle 100, 200 using a single fastener. The machined mounting surfaces are designed to provide a tactical rifle with rigidity and precision equal to or greater than that of non-modular weapons.

The buttstock 630 can provide a plurality of adjustments to allow users with varying physical features to obtain a spot weld for precision shooting. For example, the buttstock 630 can provide adjustable length of pull, i.e., the distance between the end of the buttstock and the trigger. The length of pull can be adjustable using a cam adjuster that can be quickly adjusted regardless of whether the user is wearing gloves.

Figure 6:
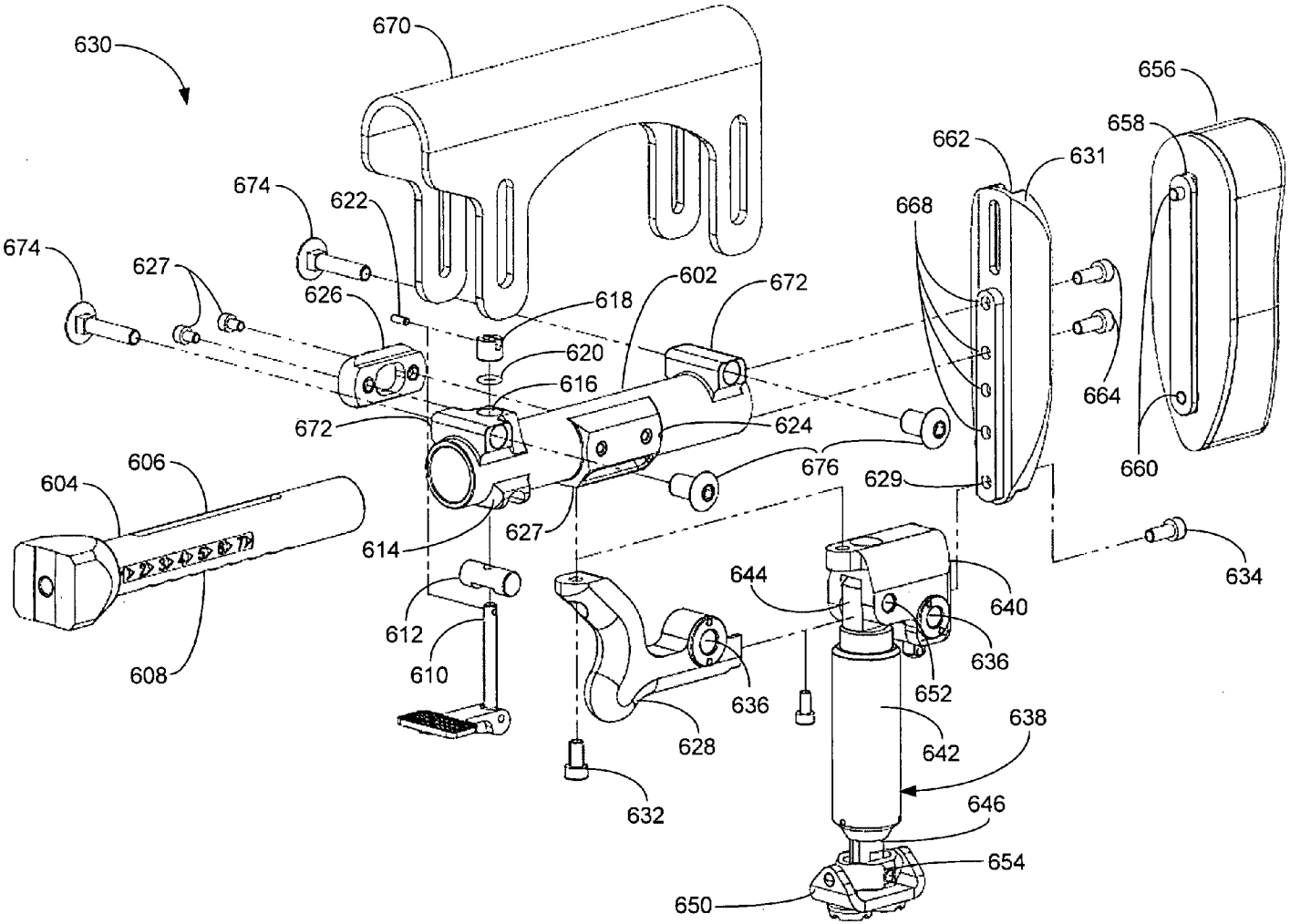
FIG. 6 illustrates an exploded view of a modular, adjustable buttstock used in accordance with some embodiments of the present invention.

Referring to FIG. 6, the main structure of the buttstock 630 is provided by an outer girder 602 disposed about an inner girder 604. The outer girder 602 and inner girder 604 can be manufactured to provide a precise fit, preferably less than 0.010 inches. The inner girder 604 can be movable within the outer girder 602 thus providing a length of pull adjustment. The inner girder 604 can comprise a slot 606 and a series of relief cuts 608 that provide incremental length of pull adjustments. In an exemplary embodiment, the relief cuts can be at approximately 11 mm/0.4 inch increments. The outer and inner girders 602,604 are preferably constructed of 7075-T6 aluminum alloy. In other contemplated embodiments, the outer and inner girders 602, 604 may be constructed of other suitable metal alloys, composite materials, and the like.

The butt stock 630 can further comprise a locking lever 610. The locking lever 610 preferably passes through a cross axle 612, a cross axle saddle 614, the slot 606 in the inner girder 604, and an aperture 616 in the outer girder 602. The locking lever 610 can be retained using retainer 618 and a washer 620. In an exemplary embodiment, the retainer 618 can be pinned to the locking lever 610 using a roll pin 622. It is contemplated, however, that other methods for retaining the cam locking lever 610 exist, such as a c-clip or a cotter pin, which may or may not use the retainer 618.

The cross axle 612 is preferably sized and shaped to engage and disengage both the relief cuts 608 in the inner girder 604 and the cross axle saddle 614 mounted on the outer girder 602. In other contemplated embodiments, the inner girder 604 and the cross axle 612 may have complimentary serrated surfaces. These surfaces can allow adjustment to any position within the length of pull range down to the resolution of the serrations.

Additionally, the locking lever 610 can pass through the slot 606 in the inner tube 604 and the orifice 616 in the outer tube 602. This can provide length of pull adjustments while preventing rotation of the outer girder 602 with respect to the inner girder 604, thus maintaining the proper axial relationship. In other words, when locked, the inner girder 604 and outer girder 602 are coupled such that the angle of the outer girder 602 to the tactical rifle 100, 200 remains constant. The locking lever 610 can enable the user to quickly and easily adjust the length of pull of the butt stock 630 by retracting or extending the outer girder 602 where it slides forward and rearward on the inner butt stock girder 604.

Commonly, adjustable length of pull stocks use spring tension and a series of preset detents to adjust stock length. The locking lever 610 used herein provides many advantageous features. The locking lever 610 relies on positive clamping action between the inner tube 604 and the outer tube 602 as opposed to spring tension and detents. The length of pull adjustment, therefore, can be continuously adjusted. Adjustment can also be along the entire adjustment range. This can also result in a buttstock that is lighter, simpler, and more rugged than typical spring-loaded butt stocks.

In an exemplary embodiment, the outer girder 602 can include a raised, tapered, accessory mounting platform 624 on both sides of the outer girder 602. This platform 624 can be used to mount a variety of accessories and/or equipment. The platform 624 can preferably be a short Picatinny rail 626 that enables the attachment of switches, remotes, or other accessories. These accessories can be, for example, communications devices, lasers, lights, and other electronic and electro-optical equipment. The raised tapered platform 624 and rail 626 can be ergonomically positioned for left or right non-shooting hand operation. In an alternative embodiment, the butt stock girder 602 can employ a dedicated electrical/electro-optic remote firing switch attachment location utilizing a 1913 Spec Picatinny Rail on the left and right side of the butt stock. In yet another embodiment, the butt stock girder 602 can comprise a dedicated electrical/electro-optic remote firing switch location integral to the raised tapered platform 624 on the left and right side of the butt stock.

The buttstock assembly 630 can include an accessory mount in some embodiments. This accessory mount can be defined by an accessory mounting hole 627 in the outer girder 602 and an accessory mounting hole 629 in the butt plate 631. This can provide a mounting location for a plurality of accessories and equipment including, but not limited to, butthooks, monopods, lasers, handgrips, radios, and flashlights.

A butt-hook 628 can be installed on the buttstock assembly 630 in some embodiments. The butt-hook 628 enables users to stabilize the tactical rifle 100, 200 with a non-shooting hand. The butt-hook 628 can also be positioned and sized such that it counter-balances the weight of the rifle barrel. This can improve the accuracy of the tactical rifle 100, 200 and reduce user fatigue. The butt-hook 628 is preferably installed on a lower portion of the butt-stock outer girder 602 using the accessory mounting hole 627 and the butt plate 631 accessory mounting hole 629 using fasteners 632 and 634, respectively. The butt hook 628 preferably possesses both left and right side flush cup sling swivel attachment points 636 to allow for the attachment of a carrying sling or other accessories. The butt-hook 628 is preferably 77.5 mm/3.05 inches in length.

In yet another embodiment, FIG. 6 illustrates the butt stock assembly 630 of the tactical rifle 100, 200 with a monopod 638 installed in place of the butt-hook 628. The monopod 638 can preferably be height adjustable. The monopod 638 can be used to support and stabilize a rear portion of the tactical rifle 100, 200 against the ground or other rest. Stabilizing the rear of the tactical rifle 100, 200 enables greater accuracy. Additionally, the monopod can reduce user shooting fatigue, particularly during extended missions, by supporting the weight of the tactical rifle 100, 200.

The monopod 638 can comprise a mounting bracket 640, an outer housing 642, an upper inner housing 644, a lower inner housing 646, and a base 650. Like the butt-hook 628, the monopod 638 can be attachable, via the mounting bracket 640, to the butt stock outer girder 602 and the butt plate 631 using fasteners 632 and 634, respectively. The upper inner housing 644 is preferably coupleable to the mounting bracket 640 using a fastener 652. The fastener 652 preferably allows the upper inner housing 644 to pivot with respect to the mounting bracket 640.

In an exemplary embodiment, the upper inner housing 644 and the lower inner housing 646 can be coupleable to the outer housing 642 using a threaded interface. The upper inner housing 644 and the lower inner housing 646 can be threaded using male thread patterns and can be threaded in opposite directions. The outer housing 642 can be threaded using the complimentary female thread patterns at both ends. Therefore, turning the outer housing 642 in a first direction can cause both the upper inner housing 644 and lower inner housing 646 to extend. On the other hand, turning the outer housing 642 in a second direction can cause both the upper inner housing 644 and lower inner housing 646 to retract.

In an exemplary embodiment, the housings 642, 644, and 646, can be threaded with a very fine thread pitch. The thread pitch can preferably be between approximately 40-56 threads per inch. This enables precise adjustment of the length of the monopod, and thus the elevation of the gun, by simply turning the outer housing 642. Turning the outer housing 642, however, engages the threads of both the upper inner housing 644 and lower inner housings 646, which can also allow for rapid height adjustment.

In an exemplary embodiment, the housings 642, 644, and 646 can be threaded using multi-start threads. The housings 642, 644, and 646 can preferably be threaded using three starts. Multi-start thread reduces the amount of rotation required on average to engage the thread when starting from a random orientation. In addition, because a multi-start thread is cut more deeply than a single start thread, the shear strength of the threads can be greater. Multi-start threads also require fewer turns to traverse the same distance than single start threads. This ratio is in proportion to the number of starts. For example, a preferred 3-start thread requires one-third the number of turns to traverse a given distance than comparable single-start threads require. Therefore, the combination of fine, multi-start threads can allow users to quickly, but precisely, adjust the elevation of the barrel of the weapon.

The lower inner housing 646 can be coupleable to the base 650 using fasteners 654. The fasteners 654 preferably allow the base 650 to pivot with respect to the lower inner housing 646. The user can simply place the base 650 on the ground, or other suitable surface, and then turn the outer housing 642 to achieve the desired barrel elevation. The height of the monopod 638 can preferably be adjusted over a 73 mm or 2.9 inch range.

In an exemplary embodiment, the rear of the buttstock assembly 630 can include an adjustable recoil pad 656. The recoil pad 656 can be designed to absorb at least part of the impact from the recoil of the tactical rifle 100, 200. The recoil pad 656 is preferably a Pachmayr Decelerator™ model D550 from Limb Saver. In other contemplated embodiments, different recoil pads can be employed such as pads constructed from rubber or other suitable advanced synthetic materials.

The recoil pad 656 can preferably be attached to an adjustable mounting rail 658 using fasteners 660. In an exemplary embodiment, the adjustable mounting rail 658 can be insertable into an adjustment channel 662 machined or cast into the butt plate 631. The user can adjust the recoil pad 656 vertically to provide for a comfortable fit. When the recoil pad 656 is in desired position, the user can tighten the fasteners 660 frictionally locking the mounting rail 658 in the adjustment channel 662. In an alternative embodiment, the recoil pad can be vertically adjustable without tools using a push button or quarter-turn release mechanism. The recoil pad 656 can preferably be adjusted over a range of approximately 5.5 inches. Additionally, contemplated embodiments of the invention can include spacers that can provide additional adjustment to the length of pull of the butt stock assembly 630.

The butt plate 631 can be attachable to the buttstock assembly 630 via the outer girder 602 using fasteners 664. The butt plate 631 can provide a plurality of mounting holes 668 to allow for additionally vertical adjustment. The butt plate 631 can be adjustable over the range of approximately 1 inch. In other contemplated embodiments, the butt plate 631 can be manufactured with varied degrees of cast for left and right handed users. In yet another embodiment, the butt plate 631 can be manufactured with curved adjustment slots to allow for manual adjustment of cast.

In yet another embodiment, the outer girder 602, butt plate 631 and/or mounting bracket 640 may be formed unitarily. This can reduce manufacturing costs by lowering the number of parts that must be manufactured and assembled. This can also create a weapon that has a more solid feel by counteracting the stacking of manufacturing tolerances. In other words, an assembly made up of many pieces, each with their own manufacturing tolerances, will feel, and may actually be, less solid than one manufactured, cast, or molded from a single piece of material.

The butt stock assembly 630 can also include an adjustable cheek piece or comb 670. The user can preferentially adjust the comb 670 to a comfortable height. The comb 670 can enable users to rest their cheek against the butt stock assembly to stabilize their head and the weapon to improve shooting accuracy. In a preferred embodiment, the comb 670 is also ergonomically designed to further increase shooting comfort. The comb 670 is preferably vertically adjustable over approximately 1.5" and in other contemplated embodiments can be laterally adjustable.

In an exemplary embodiment, the comb 670 can be attachable to the outer girder 602 via mounting bosses 672 and fasteners 674 and 676. The fasteners 674 and 676 may preferably be bolts and nuts, respectively. In other contemplated embodiments, the fasteners can be cam locks, levers, wing nuts, and the like, to allow for toolless adjustment of the comb 670.

In an exemplary embodiment, the comb 670 can be adjusted for height by loosening the nuts 676, obtaining the desired height, and then re-tightening the nuts 676 to frictionally retain the chosen setting. Slots in the adjustable comb 670 preferably provide adjustment to any position with the approximately 35 mm/1.4 inches of vertical height adjustment. This can accommodate the deployment of a variety of scope ring heights, optical scopes, and for combined application day and clip-on night, thermal sights and other devices. The comb is preferably constructed from carbon fiber reinforced plastic. In other contemplated embodiments, the comb may be constructed from other plastics, metal alloys, or other suitable materials.

Figure 7A:
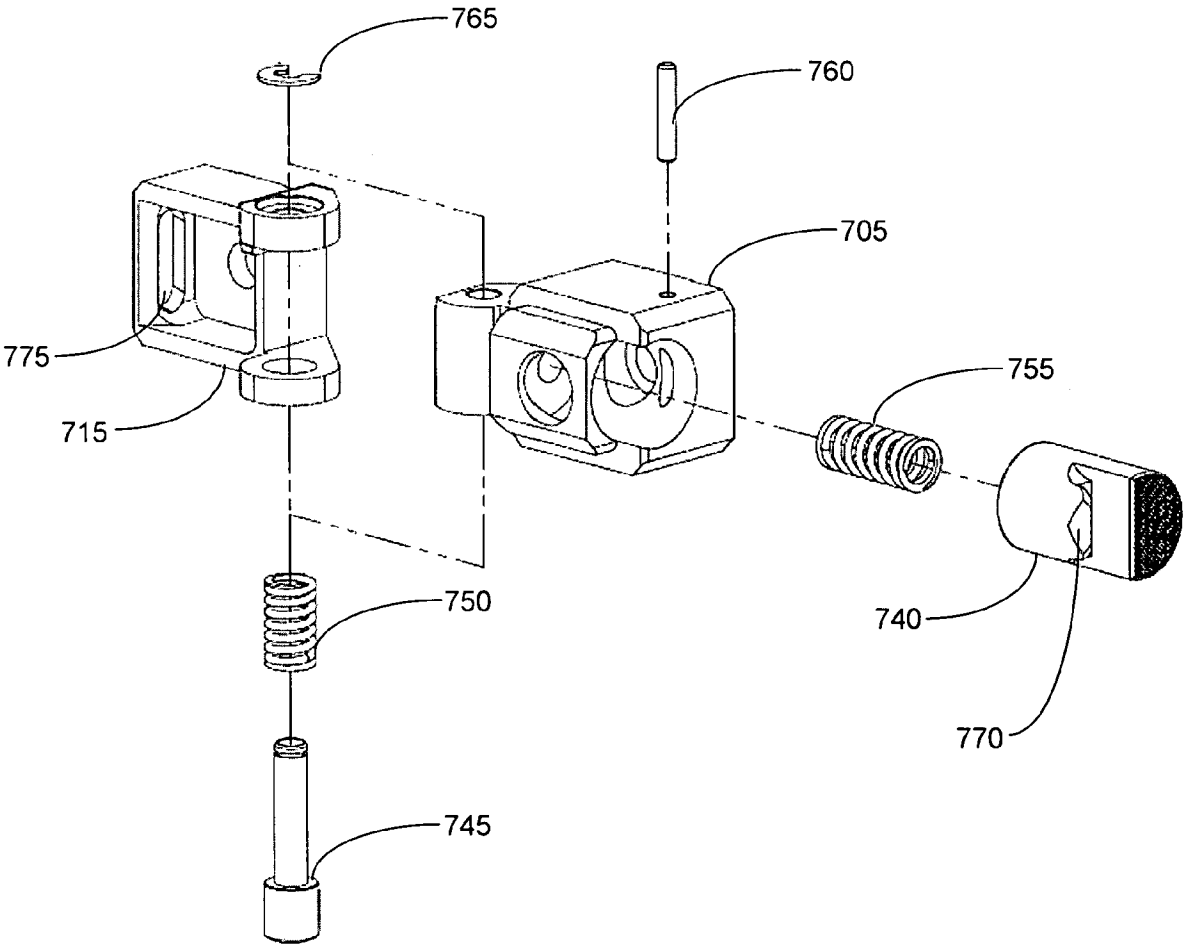
FIG. 7A illustrates an exploded view of a modular, locking hinge used in accordance with some embodiments of the present invention.

FIG. 7 illustrates an exemplary embodiment of the locking buttstock mounting system ("mounting system") 700. The mounting system 700 is preferably designed to withstand field service over the life of the tactical rifle 100, 200, including training, exercise, and combat service. The mounting system 700 preferably is adapted to sustain recoil and operational use of all modern rifle cartridges. The mounting system is preferable of a modular design. As a result, the mounting system can be adapted for use with a variety of weapons platforms.

The mounting system 700 can be operated by the user pressing the lock button 740. The mounting system 700 preferably unlocks and allows the butt stock assembly 630 to swing laterally to the left. Therefore, the mounting system 700 can have a first detent position in which the butt stock assembly is full extended. The mounting system 700 can also have a second detent position in which the butt stock assembly 630 is fully folded.

The mounting system 700 can comprise a male coupler 705 fitted into a female coupler 715. A pivot 745 can pivotally couple the male coupler 705 to the female coupler 715 through integral bores disposed coaxially in each of the couplers 705, 715. In an exemplary embodiment, the pivot 745 can include a groove to receive a retaining clip 765. A pivot spring 750 is disposed on the pivot 745 to exert a force thereon and to maintain tension on the retaining clip 765. A hinge release button 740 can be disposed in communication with the male coupler 705. The release button 740 can be retained by a retaining pin 760 and spring loaded by a release button spring 755.

The release button 740 can include a locking tang 770. When the mounting system 700 is in the first detent position, the locking tang 770 can engage a slot 775 in the female coupler 715. This can secure the mounting system 700 in the closed position, i.e., with the buttstock assembly 630 in the extended position. The release button 740 then enables the user to easily unlock and fold the butt stock assembly 630. Upon traversing to the left towards the lower receiver 620, the butt stock assembly 630 preferably is spring driven and traverses ramped portions on the male coupler 705 and the female coupler 715. When the mounting system 700 is in the second detent position, a self-tensioning design technology holds the mounting system 700 in the open position and thus the buttstock assembly 630 in the folded position.

Figure 7B:
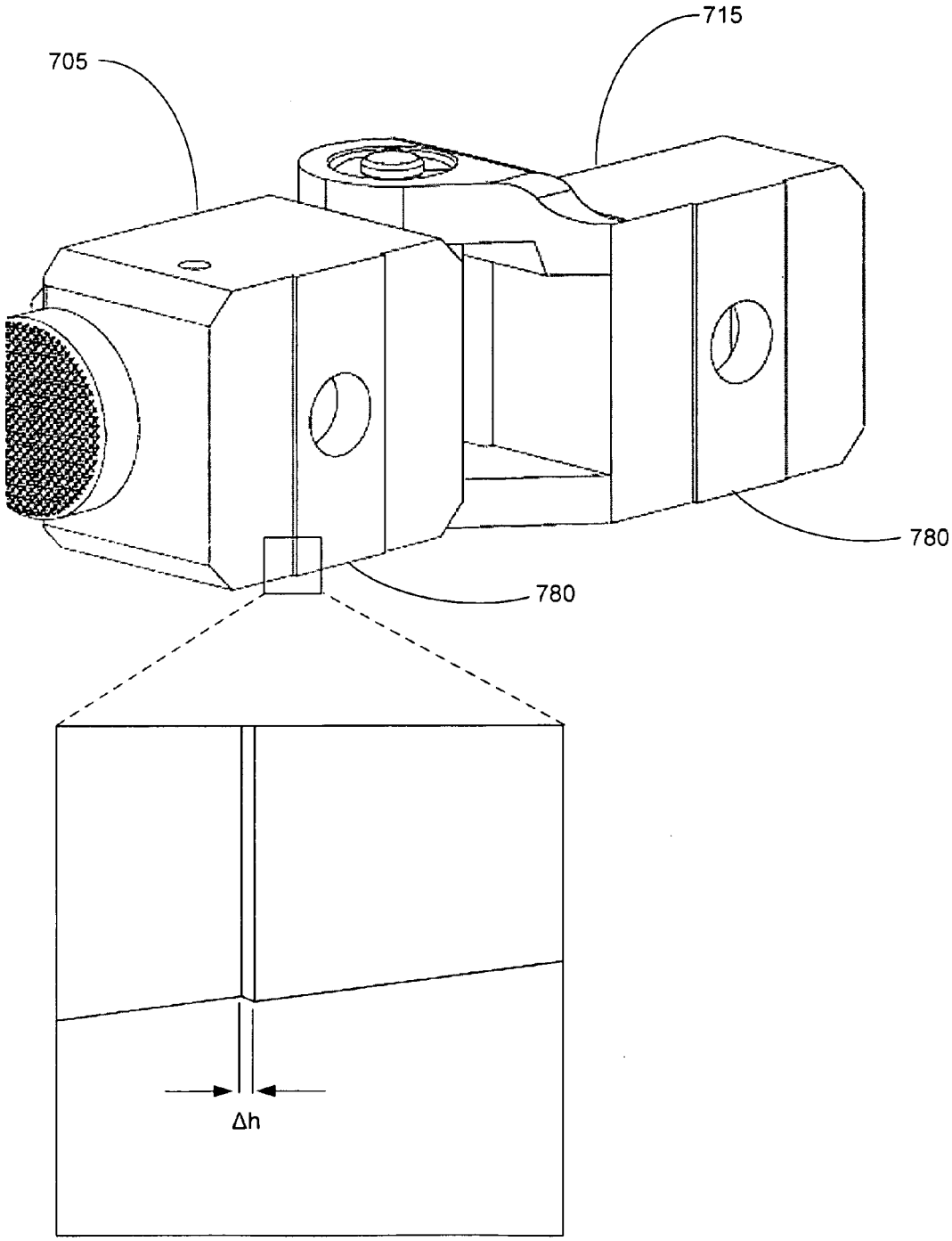
FIG. 7B illustrates a perspective view of the modular, locking hinge used in accordance with some embodiments of the present invention.

An exemplary embodiment of the mounting system 700 is shown assembled in FIG. 7B. The male coupler 705 and the female coupler 715 can be machined to include a male mounting boss 780. The mounting bosses 780 are preferably machined to a substantial depth/height to provide a precise fit with corresponding female mounting bosses located on the receiver 620 and buttstock assembly 630. In an exemplary embodiment, the mounting bosses 780 can be approximately 0.075 inches tall $\Delta h$. The mounting bosses can be machined to a tolerance of approximately 0.0005 inches. This provides a mounting system 700 that can be mounted with high precision and rigidity while utilizing a minimum of fasteners. In one embodiment, the mounting system 700 can be mounted to the buttstock 630 using a single fastener. Similarly, the mounting system 700 can be mounted to the lower receiver 620 using a single fastener.

In yet another embodiment, the buttstock assembly 630 may include a drop down 204. See FIG. 2A. In other words, the buttstock assembly 630 can comprise a mounting portion that is attachable to the mounting system 700, and may include a portion to lower the inner girder 604. This drop down 204 can be approximately 1 inch and range from approximately 0.3 inches to approximately 1.5 inches. This may be necessary, for example, to accommodate low profile scopes, scope rings, or sights and yet still allow full range of adjustability of the adjustable comb 670. In addition, it is believed that the drop down 204 creates a less direct path for recoil energy. Therefore, recoil felt by the shooter may be advantageously reduced.

Lower recoil is advantageous in several ways. For instance, lower recoil can prevent both acute and chronic injuries. Lower recoil can also increase shooter comfort. This can permit shooters to remain on station and firing for longer periods. Lower recoil can also enable the shooter to return to target more quickly after firing a shot. This is possible because the position of both the shooter and the gun are displaced less by recoil energy.

The modularity features discussed hereing enable a great deal of flexibility in the tactical rifle 100, 200 and the components thereof. Users can change components to suit their particular shooting style, and they can replace pieces that become worn or damaged on the battlefield. This is advantageous as it allows the user to replace only those components that need to be replaced. With conventional weapon systems, while some parts have separately replaceable, others required replacing the entire weapon system. This also allows for rapid upgrading in the field as improvements are made or technology advances. In addition, many of the components of the tactical rifle 100, 200 can be adapted for use on a variety of weapons systems.

Figure 8:
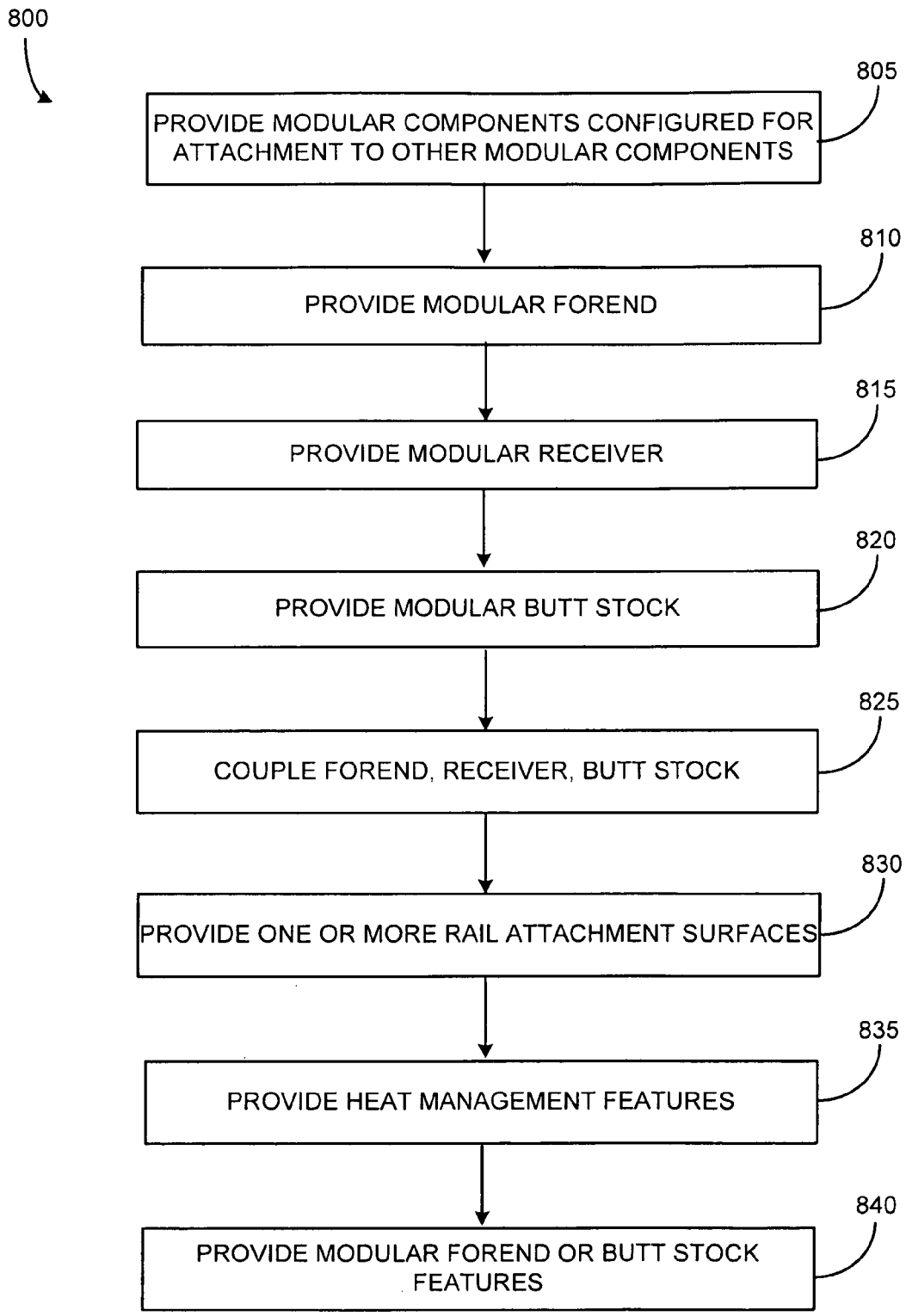
FIG. 8 illustrates a method to fabricate a tactical weapons platform in accordance with some embodiments of the present invention.

FIG. 8 illustrates a method 800 to fabricate a tactical weapons platform in accordance with some embodiments of the present invention. Those skilled in the art will understand that method 800 can be performed in various orders (including differently than illustrated in FIG. 8), additional actions can be implemented as part of a method embodiment, and that some actions pictured in FIG. 8 are not necessary. In addition, it should be understood that while certain actions illustrated in FIG. 8 may be discussed herein as including certain other actions, these certain other actions may be carried out in various orders and/or as parts of the other actions depicted in FIG. 8. Method embodiments of the present invention, such as the one depicted in FIG. 8, may be implemented to provide the various tactical weapons systems and tactical weapons platform features discussed herein.

The method 800 generally initiates at 805 by providing one or more modular components for use in assembling a weapons platform. In currently preferred embodiments, one or more of such modular components can be precision machined. By utilizing precision machined, modular components can be securedly affixed together to form a durable weapons platform. Through the use of modular components, the various modules can be adjusted by users as desired. In addition, one or more of the modular components can be manufactured with materials that are light weight, durable, and capable of managing heat produced during operation. In some embodiments, such materials can include various Aluminum Alloys and carbon composite materials.

The method 800 can also include provision of a modular forend 810, a receiver 815, and a butt stock 820. These components can be similar to the forend, receiver, and butt stock components described above. Advantageously, provision of modular components enables users and manufacturers alike the ability to interchange modular components as desired. For example, a forend can be interchanged for use to house various different barrels for use with different caliber actions. In addition, receiver assemblies can interchanged in modular fashion so that different caliber ordinance may be used. In some method embodiments, modular-adjustable grips can also be provided. Such grips can enable users to modify grip handles for varying hand, finger, and trigger movement aspects.

The method 800 can also include assembling a rifle stock chassis system by coupling and joining together a modular forend, a modular receiver, and a modular butt stock at 825. In accordance with some embodiments, the modular forend and the modular receiver can be attached together via mechanical fasteners (e.g., screws). In other embodiments, the receiver may be configured to receive a forend coupling mechanism (e.g., a receiver interface) used for coupling the modular forend to the modular receiver. The forend coupling mechanism can may be carbon-fiber bonded to a tubular-shaped forend in accordance with some embodiments.

Also, in accordance with some embodiments, the modular receiver and the modular butt stock can be hingedly coupled to each other. Use of a hinged couple enables the modular receiver and the modular butt stock to rotate relative to each other. The hinge can have a locked position so that butt stock can be locked in an extended position. In addition, the hinge can have a semi-locked position so that when folded toward the receiver, the butt stock can only be closed with adequate force. For example, in some embodiments, the hinge can be biased with a spring or cam configuration so that a folded butt stock tends to remain in a folded configuration.

The method 800 can also include providing one or more rail attachment surfaces (or rails) for use with a weapons platform at 830. In some embodiments of the present invention, the rail attachment surfaces may be 1913 spec Picatinny rails, while in other embodiments, other types of rail attachment surfaces may be utilized. The various rail attachment surfaces may have various lengths for attachment to various places. The various rail attachment surfaces may also have various pitches or rail heights so that many various devices can be attached to the rail attachment surfaces. Rail attachment surfaces can be attached to a forend of a weapons platform at varying angles (e.g., 0 degrees, 45 degrees, 90 degrees, and 180 degrees). Rails can be attached via mechanical fasteners in some embodiments and in other embodiments provided as integral attachment surfaces. Also, in some embodiments, a monolithic rail can be used along a top portion of weapons platform to mechanically link a forend portion to a receiver portion.

The method 800 may also include also providing various heat management features at 835. By providing one or more heat management features to a weapons platform, users can control how heat dissipating during use may affect use of accessories (e.g., electro-optic devices). One heat management feature can include providing heat management shields, running the length of a forend, for attachment to the forend. The heat management shields can be attached to the forend to provide a thermal shield barrier between a gun barrel and above-situated accessory devices. The heat shields can be made from carbon-based materials in accordance with some embodiments.

Another heat management feature can include provision of a free-floating barrel housed within a forend tube. Some forend configurations of the present invention can be sized and shaped to envelop and house at least a portion of a barrel extending from an action of a weapons platform. Forend tubes can be fabricated with carbon-fiber bonding techniques. Forend tubes can insulate mounted accessory devices from barrel heat and in some embodiments can assist in providing a path for heat to be wicked away via one or more heat sinks. For example, forend tubes can have one end situated proximate a receiver, and the receiver can be configured to absorb heat for passing to the ambient environment.

The method 800 may also include also providing various modular forend or butt stock features at 840. Such features may include providing swivel forend/butt-stock features, butt stock length of pull features, butt stock configuration features, and also butt-stock/monopod features. Still yet, such features may include providing a forend cap to cap a forend tube. The forend cap can have an aperture through which a barrel can pass and also enclose the forend tube. An enclosed forend tube can, in some embodiments, be used as a storage compartment for holding various accessories. In addition, a forend cap can be used to provide attachment to any number of monopods, bipods, or tripods as desired by users.

Another forend feature that can be provided is a forend end connection piece (or forend mounting mechanism). The forend mounting mechanism may be used to assist in modular interchangeability with forend configurations discussed herein. For example, a forend mounting mechanism can be carbon fiber bonded with a forend tube to provide return to zero mating to a receiver. In some embodiments, a forend connection piece may be separable from a forend and utilized for attachment to forends of many shapes and sizes.

As discussed herein, operational demands placed on a tactical rifle system require it to be adaptable to its applications, environment and configurable to shooters. One element of a tactical rifle system is a stock. Functional stock components enable stocks to perform as an interface between the shooter and working parts of a weapons platform (e.g., a rifle). Various embodiments of the present invention are directed to a modular tactical rifle stock chassis system with an adjustable folding, retractable butt stock, and various other configurable features.

The embodiments of the present invention are not limited to the particular formulations, process steps, dimensions and materials disclosed herein as such formulations, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

We claim:

1. A modular bolt action rifle chassis assembly for use with a bolt action receiver, the chassis assembly comprising:

a center chassis section, with a first end and a second end, configured to couple to a bolt action receiver;

a forend assembly adapted to house a portion of a barrel associated with the bolt action receiver in a free-float arrangement, the forend assembly detachably coupleable to the first end of the center chassis section;

a monolithic rail coupled to at least a portion of a top surface of the forend assembly, the monolithic rail being sized and shaped to extend along at least half the length of the forend assembly, and being disposed above the center chassis section and sized and shape to extend at least half the length of the center chassis section; and a butt stock assembly hingedly coupled to the second end of the center chassis section.

2. The modular bolt action rifle chassis assembly of claim 1, the monolithic rail extending substantially the entire length of the forend assembly and the center chassis section.

3. The modular bolt action rifle chassis assembly of claim 1, wherein the interfaces between the center chassis section, the bolt action receiver, and the buttstock assembly are free of a bedding compound.

4. The modular bolt action rifle chassis assembly of claim 1, the butt stock assembly further comprising a vertically adjustable recoil pad.

5. The modular bolt action rifle chassis assembly of claim 1, further comprising a grip configured to detachably couple to the center chassis section at a plurality of different points so that the grip position relative to the center chassis section is variable, such that the angle of the grip, the distance from the grip to a trigger, or both is adjustable.

6. The modular bolt action rifle chassis assembly of claim 1, the forend assembly further comprising at least two mounting interfaces for coupling additional rails at different orientations and heights along the forend assembly, the mounting interfaces spaced apart at predetermined intervals such that at least one of the mounting interfaces is configured to enable coupling of an electro-optical device to the forend assembly at an orientation wherein a beam generated by the electro-optical device is parallel to and in the same vertical plane as the bore line of the barrel.

7. The modular bolt action rifle chassis assembly of claim 1, wherein the monolithic rail comprises a cant of between 0 and 60 MOA.

* * * * *